US012768084B2

(12) United States Patent
Grappe et al.

(10) Patent No.: US 12,768,084 B2
(45) Date of Patent: Oct. 20, 2026

(54) APPARATUS AND METHOD FOR MICROWAVE CARBONIZATION OF POLYMERIC MATERIALS FOR CARBON FIBER PRODUCTION

(71) Applicants: Hippolyte A. Grappe, Oak Ridge, TN (US); William W. Wallace, North Dighton, MA (US); Felix L. Paulauskas, Knoxville, TN (US); H. Felix Wu, Frederick, MD (US); Joshua T. Brady, Knoxville, TN (US)

(72) Inventors: Hippolyte A. Grappe, Oak Ridge, TN (US); William W. Wallace, North Dighton, MA (US); Felix L. Paulauskas, Knoxville, TN (US); H. Felix Wu, Frederick, MD (US); Joshua T. Brady, Knoxville, TN (US)

( * ) Notice: Subject to any disclaimer, the term of this patent is extended or adjusted under 35 U.S.C. 154(b) by 1045 days.

(21) Appl. No.: 17/902,818

(22) Filed: Sep. 3, 2022

(65) Prior Publication Data

US 2024/0076807 A1 Mar. 7, 2024

(51) Int. Cl.
*D01F 9/14* (2006.01)
*D06M 10/00* (2006.01)

(52) U.S. Cl.
CPC ..... *D01F 9/14* (2013.01); *D06M 10/003* (2013.01)

(58) Field of Classification Search
CPC ..... D01F 9/14; D01F 9/32; D01F 9/00; D01F 9/08; D01F 9/12; D01F 9/324; D01F 9/326; D01F 9/328; D01F 11/00; D01F 11/02; D01F 11/04; D01F 11/06; D01F 11/08; D01F 11/10; D01F 11/12; D01F 11/121; D01F 11/122; D01F 11/123;
(Continued)

(56) References Cited

U.S. PATENT DOCUMENTS 4,197,282 A 4/1980 Bailly-Lacresse et al.
6,372,192 B1 4/2002 Paulauskas et al.
(Continued)

OTHER PUBLICATIONS

Chen, et al., A Two-Step Microwave Annealing Process for PAN Pre-Oxidation through a TM-Mode Cavity, Polymers 2021; 13: 1476, pp. 1-11 (Year: 2021).*
(Continued)

*Primary Examiner* — Daniel C. McCracken
(74) *Attorney, Agent, or Firm* — Robert J. Lauf

(57) ABSTRACT

An apparatus is disclosed for electromagnetically and thermally treating polymeric materials, including PAN and other carbon fiber precursors at large scale at atmospheric pressure, while measuring the temperature in the closed environment of the process chamber. The apparatus is designed for continuous processing, and to be compatible with other stages of existing carbon fiber production lines. It provides direct electromagnetic coupling to the fiber tow(s) in the near-field region of one or more microwave waveguide launchers and also provides direct radiative or IR heating from susceptor plates located on the opposite side of the tow from the waveguide opening for processing a band of multiple tows of fiber. It produces low-temperature-carbonized (LTC) fiber with shorter residence time and higher density compared to the conventional process. Its design is inherently scalable to larger production. A related method is also disclosed.

20 Claims, 16 Drawing Sheets

(58) Field of Classification Search
CPC .... D01F 11/124; D01F 11/125; D01F 11/126; D01F 11/127; D01F 11/128; D01F 11/129; D01F 11/14; D01F 11/16; D06M 10/003; D06M 10/00
See application file for complete search history.

(56) References Cited

U.S. PATENT DOCUMENTS

| | | | | |
|---|---|---|---|---|
| 6,375,875 | B1 | 4/2002 | Paulauskas et al. | |
| 9,427,720 | B2 | 8/2016 | White et al. | |
| 9,745,671 | B2 | 8/2017 | Suzuki et al. | |
| 2014/0103031 | A1* | 4/2014 | Peelamedu ..... | H05B 6/6491 219/759 |
| 2020/0056306 | A1 | 2/2020 | Kim et al. | |
| 2021/0115598 | A1 | 4/2021 | Shin et al. | |

OTHER PUBLICATIONS

Peebles, L. H. "Carbon Fibers—Formation, Structure, and Properties" CRC Press, 1995, pp. 7-25 and 128-135.
Donnet, J.-B., et al. "Carbon Fibers" Third Ed., Marcel Dekker Inc., 1998, pp. 26-31.
Morgan, P. "Carbon Fibers and Their Composites" CRC Taylor and Francis, 2005, pp. 195, 196-197, 200-203.
Paulauskas, F. L. et al., "Temperature-Dependent Dielectric Measurements of Polyacrylonitrile Fibers during Air Oxidation" SAMPE 2004, May 16-20, Long Beach, CA.

* cited by examiner

APPARATUS AND METHOD FOR MICROWAVE CARBONIZATION OF POLYMERIC MATERIALS FOR CARBON FIBER PRODUCTION

STATEMENT REGARDING FEDERALLY SPONSORED RESEARCH

This invention was made with Government support under Contract No. DE-AC05-00OR22725 awarded by the U.S. Department of Energy to UT-Batelle LLC, and the Government has certain rights in this invention.

BACKGROUND OF THE INVENTION

Field of the Invention

The invention pertains to apparatus and methods for manufacturing carbon fiber, and more particularly, to apparatus and methods for carbonizing polymeric fibers using near-field electromagnetic treatment.

Description of Related Art

Carbon fiber is a material with very high specific stiffness and strength, hence is very attractive for weight-critical applications. However, it comes at a high cost, so it is typically used in structures in which weight reduction justifies the high cost premium. Carbon fiber is also very attractive for use in heavy vehicles and automotive passenger platforms as well as in other industries where its use offers weight reduction and energy efficiency gains. However, the production of carbon fiber is lengthy and expensive. It is estimated that to be massively adopted in those industries, the price of carbon fiber must be reduced by approximately half. It is generally observed that commercial grade carbon fiber production cost is about evenly divided between the cost of the precursor and the cost of converting the precursor to carbon fiber. The low temperature carbonization stage is one of the most energy intensive process steps. Significantly reducing the energy consumption of low temperature carbonization (LTC) per unit mass would allow the carbon fiber to be one step closer to broader adoption in the industry.

FIG. 1 shows a diagram of all steps encountered by the material in a conventional line of conversion as in the current industry: pre-treatments, stabilization/oxidation, low temperature carbonization, high temperature carbonization, graphitization (optional), surface treatment, and sizing. The low temperature carbonization (outlined by the dashed line in FIG. 1) is the first step of carbonization, where major morphological changes occur and where most of the effluent is released, leaving behind a high percentage of carbon containing fiber.

Carbon fiber is produced from a variety of precursors. The predominant raw materials are polyacrylonitrile (PAN), mesophase pitch, and rayon. Natural precursors such as cellulose or lignin also exist but are not commonly used in the industry. In most cases, the precursor is spun in tows of continuous filaments. Then it may be pre-stretched before being stabilized in an oxidative environment (usually in air at 200° C.-400° C. for several hours, depending upon the precursor) [see Peebles L. H., "Carbon Fibers-Formation, Structure, and Properties", CRC Press, pp. 7-25 and 128-135 (1995)]. After the stabilization process, the material becomes a thermoset. It is matte black, infusible, flameproof, and is usually referred to as "oxidized fiber". This oxidized fiber is sufficiently stable for exposure to significantly higher carbonization temperatures and graphitization under an inert environment, usually nitrogen. The carbonization process is divided into two or three stages. The first carbonization stage is LTC and operates in the 350° C.-800° C. temperature range. The second carbonization stage is high temperature carbonization (HTC). This second stage thermally treats the fiber between 800° C. and 1500° C. [see Donnet, J.-B. et al., "Carbon Fibers", Third Edition, Marcel Dekker, Inc., pp. 26-31 (1998)].

Optionally, carbon fiber can be given a third and last thermal treatment between 2000° C. and 3000° C., referred to as graphitization. In this last stage the fiber acquires a graphite-like structure while losing almost all its impurities and experiencing a negligible weight variation. To some extent, the Young's modulus is function of the highest temperature the fiber has been exposed during the graphitization stage [see Moragan, P., "Carbon Fibers and their Composites", CRC Taylor and Francis, pp. 200-203; and Donnet, J.-B. et al., "Carbon Fibers", Third Edition, Marcel Dekker, Inc., p. 29 (1998)]. Thus, graphitization produces carbon fiber with extremely high stiffness.

Once the material is fully carbonized, the carbon fiber's surface is conditioned to obtain the final product by dipping it in an electrolytic or acidic bath. The fiber, configured as an anode, travels between cathodes made of graphite. Finally, the tow is coated with a sizing for handleability and packaging purposes.

Electromagnetic (EM) energy sources, i.e. microwave, for material processing and carbon fiber conversion have been used since the 1970s. The application and the efficiency of EM as an energy source is highly dependent on the design of the processing chamber, power transmission line, the geometry of the antenna system relative to the load, modes, pattern of radiation, management and control of the energy inside the chamber (i.e., control of reflections), yield efficiency, sustainability, resonance, and in general, the overall configuration of the hardware processing system.

Among the earliest work using EM energy source for carbon fiber precursor conversion is reported in the Japanese Pat. Specification No. 4,724,186, published on Jul. 4, 1972, and natural organic spun material in a batch mode (U.S. Pat. No. 4,197,282, Lacress, et al.). Since then, this energy source has been researched significantly, but never put into commercial production.

Since 2000, the Oak Ridge National Laboratory has been issued several patents related to the carbonization of carbon fiber precursors using a microwave (MW) plasma generated in vacuum. U.S. Pat. No. 6,372,192 to Paulauskas, et al. describes the carbonization of material batches wrapped around a static frame exposed to a plasma. U.S. Pat. No. 6,375,875 to Paulauskas, et al. discloses a technique that uses frequency sweeping in the microwave band to characterize carbon fiber. In addition to using EM power to carbonize material, the dielectric properties of fiber can be measured by radiating with low power EM energy and analyzing the reflection waves. In this last case, MW energy is not used to convert the polymer into carbon fiber.

U.S. Pat. No. 9,427,720 to White, et al. describes a process of comprehensive carbonization for multiple tows in one single stage using plasma generated by MW under vacuum. The oxidized PAN fiber (OPF) material is exposed to a gradient of MW power in an elongated cavity in a low-pressure gas. This cavity features two eyelets, one on each end, so that OPF is fed in one end and processed fiber (fully carbonized CF) exits at the other end. This cavity is subjected to a moderate vacuum. Part of the gas effluent generated while the fiber undergoes thermal conversion is utilized as a plasma working gas to reduce the consumption of nitrogen. Because of the gradient of MW energy along the cavity, the plasma is heterogeneous: the plasma has a higher density toward the exit of the process, whereas, on the entrance side, where the OPF is introduced, the plasma is almost nonexistent. In this region, the MW is predominant. This system has the capability of processing multiple tows simultaneously.

U.S. Pat. No. 10,260,173 to Zushi et al. describes the carbonization of oxidized PAN fiber at atmospheric pressure. This technique uses a cylindrical or a rectangular waveguide as a processing cavity. Furthermore, it uses a conventional heat source at the end of the process. The microwave energy is absorbed by the material along the processing cavity. This technic does not use any susceptor or other microwave absorber. The energy that has not been absorbed by the material is reflected back at the end of the cavity, having a second chance being absorbed by the material, but also creating a standing wave. This method claims the potential of carbonizing the material faster than the conventional process by at least a factor three. However, it seems to be constrained by the geometry of the waveguide in use, limiting this application to narrow tows or a small amount of material (the size of the tow is not disclosed). Multiple tow processing is not considered.

U.S. Pat. No. 9,745,671 to Suzuki describes a carbonization method and carbon fiber production method based on plasma generated by microwaves. This method involves a series of up to three furnaces in line, with a gradient of temperature. Two types of furnaces are used: furnaces involving plasma and conventional electric resistive furnaces. A series of examples using multiple combination of these two types of furnaces is detailed with the processing conditions (when utilized, the plasma furnaces are operating in the 1 to 8 kPa pressure range). This method is comparable to the one described in U.S. Pat. No. 9,427,720 (T. White, et al.) noted above. The main difference between these two patents is the capability in dissociating the carbonization in multiple stages, giving the opportunity of setting individual tension to each of them with the work of Suzuki. The best mechanical properties reported with this method are 5 GPa for the tensile strength and 300 GPa for the tensile modulus.

JP Pat. No. 5,191,004 (2013) describes a continuous process for the production of carbon fibers by applying high frequency electromagnetic waves as the feedstock fiber travels through a cavity. The cavity is configured as a coaxial system where the fiber is the inner conductor. This system is capable of converting oxidized fiber into carbon fiber under inert atmosphere.

Recently U.S. Pat. Appl. Pub. Nos. 2020/0056306 to Kim, et al., and 2021/0115598 to Shin, et al. disclose an apparatus in which a single tow is processed by direct exposure to the MW through a single port and the system further uses a MW susceptor inside a non-resonant cavity. In U.S. Pat. No. 2020/0056306 Kim, et al. describe an apparatus using microwaves for carbon fiber manufacturing. It is claimed that multiple sections of this apparatus can be used in series to 1) stabilize the precursor in one to two hours, and then 2) carbonize the stabilized material with one or more stages by using a susceptor located in the main cavity heated up to the 400-1500° C. range. This susceptor can have multiple shapes and should occupy 0.1% to 5% of the volume of the main cavity. With this method the tensile strength and the modulus of the treated fiber can reach 2.5 GPa and 190 GPa respectively. However, it is difficult to assess the real performance of this invention because the grade of feedstock material is not mentioned (e.g., aerospace grade, commodity grade, or textile grade).

Objects and Advantages

Objects of the present invention include the following: providing an apparatus for low temperature carbonization of a continuous fiber tow using electromagnetic energy; providing an apparatus for low temperature carbonization of a continuous fiber tow using electromagnetic energy with supplemental radiant heating from a susceptor material in a non-resonant cavity; providing an apparatus for low temperature carbonization of a continuous fiber tow that yields improved density and reduces processing time; providing an apparatus for carbonization of a continuous fiber tow using electromagnetic energy that produces not only low temperature carbonization but also some high temperature carbonization; and, providing a more efficient process for carbonization of a continuous fiber tow. These and other objects and advantages of the invention will become apparent from consideration of the following specification, read in conjunction with the drawings.

SUMMARY OF THE INVENTION

According to one aspect of the invention, an apparatus to partially carbonize stabilized carbon fiber precursor materials comprises:

- a power supply and transmission line to provide a source of electromagnetic energy of a selected power and frequency into a waveguide;
- an applicator cavity including:
  - at least one open waveguide launcher operable to deliver the electromagnetic energy into the cavity; and,
  - a body of susceptor material facing the open waveguide launcher and spaced apart therefrom to form a gap through which a tow of carbon fiber precursor material may pass so that the material is simultaneously exposed to the electromagnetic energy from the open waveguide and to radiant thermal energy from the susceptor body;
- openings in both ends of the applicator cavity, so that the precursor material passes through the cavity as a continuous fiber tow in a selected atmosphere at ambient pressure; and,
- a control system and user interface to monitor and control the power supply based on selected process inputs.

According to another aspect of the invention, a method to partially carbonize stabilized carbon fiber precursor materials includes:

- providing a source of electromagnetic energy of a selected power and frequency;
- delivering the electromagnetic energy to an open waveguide structure to launch the electromagnetic energy into a cavity;
- providing a body of susceptor material in front of the open waveguide and spaced apart therefrom to form a gap through which the precursor material passes as a continuous fiber tow in a selected atmosphere at ambient pressure; and,
- pulling the fiber tow through the gap at a selected speed so that the tow is exposed to direct electromagnetic energy from the open waveguide and simultaneously to radiant thermal energy produced in the susceptor material by electromagnetic energy absorbed therein.

The invention may further include a gas mixture, used to create an inert environment, which may be injected into the device at ambient temperature. The gas mixture does not need to be preheated and is not used to control the temperature of the fiber to enhance coupling to the EM energy.

BRIEF DESCRIPTION OF THE DRAWINGS

The drawings accompanying and forming part of this specification are included to depict certain aspects of the invention. A clearer conception of the invention, and of the components and operation of systems provided with the invention, will become more readily apparent by referring to the exemplary, and therefore non-limiting embodiments illustrated in the drawing figures, wherein like numerals (if they occur in more than one view) designate the same elements. The features in the drawings are not necessarily drawn to scale.

FIG. 3A represents four tows processed in parallel and FIG. 3B represents seven tows processed in parallel in accordance with some aspects of the invention.

FIG. 6A is a perspective view of the standoff device, and FIG. 6B is a detail view of some internal details thereof.

FIG. 11A shows the side rail and FIG. 11B shows an end detail.

DETAILED DESCRIPTION OF THE INVENTION

Figure 1:
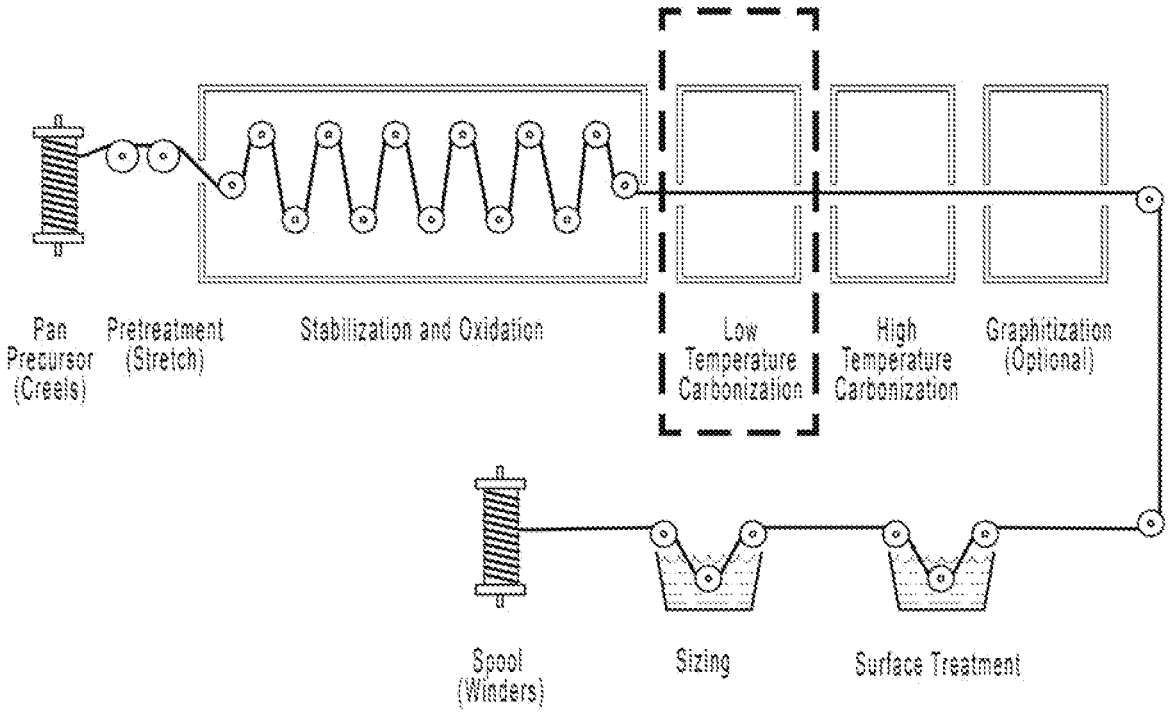
FIGURE 1 PRIOR ART
FIG. 1 is a schematic diagram of conventional carbon fiber processing steps according to the Prior Art.

The present invention aims to replace the existing low temperature carbonization (LTC) furnaces in an industrial conversion line, but a traditional high temperature carbonization (HTC) step is still required to produce carbon fiber with the desirable mechanical properties. However, Applicants have discovered that the invention is able to effect processing not only in the LTC regime, but also partway into the HTC regime, so that in the subsequent processing step, the HTC furnace may be smaller than what is traditionally specified. Two main differences between the invention and the technique currently used in the industry are its energy source and the configuration of the processing cavity. The invention uses energy from both electromagnetic (EM) power and radiant heating from an EM-absorbing susceptor located adjacent to the fiber tow to convert the material, with the electromagnetic power being dominant. By contrast, in current industry practice, conventional furnaces use radiative heating alone.

The invention differs from prior references in many ways:

Compared to the work done by S. Kim, the present invention does not cover the stabilization of the precursor. The reasons are as follows: First, for PAN material, the process of stabilization involves an oxidation of the polymers. This must happen in an oxidative environment, typically air. Convection is usually implemented in production lines because it benefits this process of oxidation. Additionally, convection helps in preventing violent exothermic reactions and in achieving a better homogeneity of the temperature in the cavity. But, more importantly, for safety reasons, convection efficiently contributes to the renewal of the gas mixture in the cavity, preventing the explosion risk caused by the accumulation of reactive gases (see, e.g., Morgan P., "Carbon Fibers and Their Composites", CRC Taylor and Francis, pp. 196-197). Equipment lacking the convection feature might offer poor performance with the process of oxidation and might represent some risk at large scale. Second, to avoid filament fusing in the material, the stabilization process must occur under 300° C. However, it is demonstrated that the PAN precursors are almost transparent to the EM source in the band of interest at any temperature below 350° C. In other words, the PAN fiber couples poorly with the microwave energy, and its direct exposure to a MW source under 300° C. does not contribute to the thermal treatment of the material. With the present invention, a process of stabilization of the fiber can only be achieved with the IR re-radiation of the susceptor. Furthermore, in addition to not being capable of providing better performance for oxidation/stabilization purposes compared to conventional electric heating ovens, this configuration is likely to offer a poor energy efficiency due to the energy losses at each step of the process (electric power to MW generation losses, MW energy to susceptor absorption losses, and absorbed energy suffering radiated losses). These two observations show that using a susceptor is unlikely to provide noticeable gains when compared to the standard residence time of approximately 100 min used in the industry for the conventional oxidation/stabilization method (see Morgan P., "Carbon Fibers and their Composites", CRC Taylor and Francis, p. 195). According to the literature, the effectiveness of the oxidative treatment is limited for when the residence time is extended beyond 100 min. Finally, a balance of energy consumption per mass unit is not provided by the author for the present invention, if used for oxidation/stabilization process.

When used for carbonization, the present invention differs to the one described in U.S. Pat. Appl. Pub. No. 2020/0056306A1 by the following characteristics: 1) it does not have to be located in-line with any other treatment; 2) the feedstock material is stabilized fiber or equivalent infusible material; 3) it uses composite susceptors to improve heat conduction and scalability; 4) the volume of the susceptor has no theoretical restriction and does not have to occupy 0.1 to 5% of the volume of the cavity; 5) it can treat multiple medium-size tows and is scalable; 6) it uses multiple ports with adjustable locations, allowing a controlled exposure of the material to the MW energy; 7) a closed loop system permits a measurement of the undesirable transmitted signal from port to port to adjust the parameters of the system accordingly; 8) a solid state EM source is used to control the phase of each port, allowing for defining locations of the ports while getting a better control of the standing waves in the processing cavity; 9) a solid state EM source with an adjustable frequency and resolution of 1 MHz is used—this provides the capability to aim bands as narrow as few MHz, minimizing the energy reflection and improving the energy efficiency of the system; 10) as built, this invention is designed for LTC, and is able to produce fiber with unique characteristics compared to the material usually obtained with a conventional setup (high density vs, moderate conductivity within a sub-minute residence time).

In U.S. Pat. Appl. Pub. No. 2020/0056306A1 (see paragraph [0033]), the author describes the carbonization furnace as follows: "the microwaves directly heat the precursor without heating the main body". In the next paragraph, [0034], he indicates that "the heating body may be positioned inside the main body, and is directly heated by the microwaves emitted from the micro emitting unit to serve to indirectly carbonize the precursor." In contrast to that description, in the present invention the fiber and the susceptor are simultaneously irradiated by the EM source. During the transition state, where the system goes from room temperature up to the set point, the material experiences a drastic change of its dielectric properties. From its initial state of transparency at room temperature, it becomes partially absorptive (above 350° C.). In the explored range of temperature, the fiber does not become a good absorber allowing for a part of the energy to be directly absorbed by fiber material. A portion of the EM energy, as function of the temperature of the fiber, remains transmitted to the susceptor. At constant power, the susceptor is continuously receiving transmitted energy, increasing or maintaining its temperature. The temperature of equilibrium is defined by the processing conditions (loss of material, line speed, power level, etc.). The transmitted EM energy is either absorbed by the susceptor (hence contributing to maintain or increase its temperature), or it is diffracted. All the diffracted energy that is neither interfered with an incident wave delivered by another port (another open waveguide launcher), nor absorbed by the material, might irradiate out of the processing chamber and, eventually, be absorbed in the chokes (damper sections). At low temperature carbonization, the material does not become conductive/reflective enough to disable its coupling with the EM waves.

Eventually, S. Kim finds in his invention a correlation between the size of the susceptor and the efficiency of the process: smaller the susceptor is, the better the process. With the current invention, the system does not theoretically depend on the volume nor relative size of the susceptor. The variables of interest are the distance to the waveguide, the distance to the fiber, the surface of the susceptors that is insulation free, the efficiency and the microwave transparency of the insulation (thermal properties and dielectric properties). The main impact of the volume of the susceptor is the warm-up time at a given power level (the larger the susceptor volume, the longer the warm-up time).

In US Pat. Appl. Pub. No. 2021/0115598A1, J. H. Shin, et al. present a system that allows the full process of carbonization (LTC and HTC) in potentially one step of single tow using a tube and a susceptor that encompasses ~270° of the circumference of the outer surface over a portion of that tube. The tube is transparent to microwaves over the temperature range 25-1500° C. At the frequency of interest, its loss tangent remains in the range of tan $\delta=3.5\times10^{-4}$ to $6.8\times10^{-4}$. The inventor states that this design is limited to small scale (quartz is used and its cross section represents 5.9% or less from the cross section of the embodiment). The inventor also indicates that the indirect heating efficiency may deteriorate with the increase of the diameter of the tube (see paragraph) [0050]), likely because the susceptor has to be located outside of the tube. The presence of a tube is a geometrical limitation of this reference. By design, this reference is limited to sample production and cannot be scaled up for industrial production. Furthermore, despite the softening point of quartz being in the 1650-1700° C. range as referenced by several quartz manufacturers, some of them recommend a limit of 1050° C. for continuous operation, and up to 1250° C. for non-continuous usage. Even if quartz has the desirable dielectric properties over the entire range of the temperature of carbonization (LTC and HTC), it may not be ideal for continuous operation at HTC, especially if acts as a structural element in the invention. Therefore, the thermal and mechanical properties of the quartz tube are not an issue for processing material at LTC, but can be at HTC. In addition, the tubular geometry is a clear limitation for using this reference at larger scale.

On the other hand, the present invention eliminates this geometrical issue by not using a tube. The two major advantages are: scalability and susceptor layout improvement (the susceptor system lays in the processing cavity, offering the possibility to be located as close as possible to the fiber, increasing the cross section of the fiber to the IR re-radiation). Three designs (A, B, and C) are presented for the present invention: the first one (A) is using a rectangular sleeve made of quartz. Its initial usage is justified by the low temperature of operation for LTC process (not exceeding 900° C.) to accommodate conveniently the requirements of the current invention. It is observed that using the quartz sleeve is optional, and it is recommended that instead of the quartz material one could use the same material that was used for the insulation of other parts of the furnace, viz., sintered alumina ceramic, allowing better scalability. This insulative material has a tan $\delta\leq0.01$ up to 1500° C. and is rated to up to 1700° C. The second design (B), which is more relevant for scaling, takes into account the issue related to the quartz material. Design (B) is identical to design (A), except the quartz sleeve is replaced by the sintered alumina insulation. The resulting configuration is free of quartz and is built with sintered alumina insulation only. This configuration allows for more versatility regarding the design of the cavity and its housing. Hence, the design of the cavity using design (B) does not have to be limited by what is achievable as a structure with quartz. The third design (C) represents a theoretical view of a scale up of design (B). This configuration takes advantage of the basic geometry of the susceptors, the versatility of the sintered alumina insulation, and the multiple waveguide launcher design mastered with design (A). Design (C) is a path to industrial-scale implementation using this invention.

This invention establishes a new apparatus for modifying the bulk properties of polymeric materials, including polyacrylonitrile (PAN) fiber. The energy in use is an electromagnetic (EM) source that is delivered through a set of wave guides directly to the load. The load is composed of the fiber traveling through the cavity and a set of susceptors (absorbers) that remain in static position, facing their respective waveguides on the opposite side of the traveling fiber. The concepts involved are:

1. Coupling the fiber with the propagating EM energy in the near field at elevated temperature (the material, e.g., the oxidized PAN fiber (OPF), does not couple at room temperature).
2. Setting the geometry of the system in order to absorb the transmitted EM waves not directly absorbed by the fibers by means of susceptors and re-radiating this energy as IR evenly across the width of the tow being processed.

As built, the system is capable of partially carbonizing a band of multiple tows at atmospheric pressure with a shorter residence time (less than a minute) compared to conventional process (usually 75 seconds or more). This approach can potentially improve the energy usage required under certain conditions. Eventually, the resulting fiber showed unique properties that might find novel applications.

A key concept of this invention and method relies on the dielectric properties of the materials involved. Coupling characteristics of the fiber is a function of its temperature and the frequency of the EM source. An example of these characteristics is shown in FIG. 2.

The invention uses a set of waveguides that independently radiate the fiber. This creates distinct regions, one per waveguide, of high field intensity on the passing band of multiple tows of oxidized PAN fiber (OPF). As demonstrated with the measurement in FIG. 2, dielectric heating is not possible at room temperature because of low permittivity. However, the permittivity of the OPF increases significantly with temperature. As a result, the material becomes more lossy and eventually couples sufficiently with EM waves. For PAN fiber, coupling at 2.45 GHz becomes possible around 300° C. and higher.

Example

Figure 2:
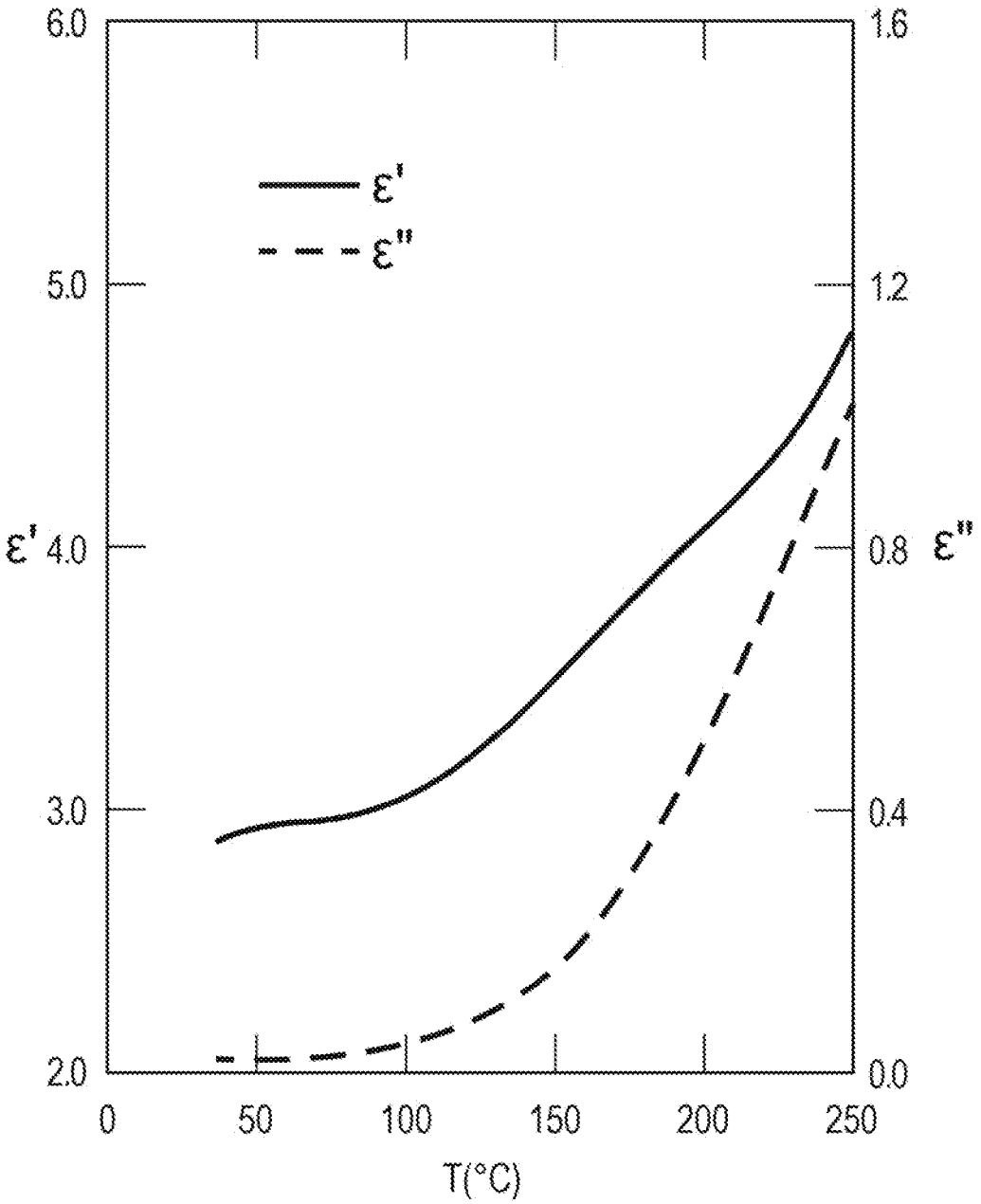
FIGURE 2 PRIOR ART
FIG. 2 is a plot of the permittivity/dielectric properties of oxidized PAN material at 2.45 GHz as a function of temperature [see "Temperature-Dependent Dielectric Measurements of Polyacrylonitrile Fibers during Air Oxidation," F. L. Paulauskas and T. L. White, presented and published at SAMPE 2004, May 16-20, 2004, Long Beach, CA].

As an example, a calculation of the tan δ, which is an indication of how lossy the material is to EM excitation, using FIG. 2 and defined as $\tan\delta=\varepsilon''/\varepsilon'$, shows the significant increase of 30× of this property between 50° C. and 250° C. Thus, the material becomes 30 times lossier at 250° C. versus 50° C., which is a positive characteristic exploited by the present invention.

TABLE 1

Calculation of tan δ (at 2.45 GHz) for oxidized PAN material based on the values of ε' and ε" (farad/m) at 50° C. and 250° C.; data from measurements reported in FIG. 2.

| Temperature, ° C. | ε', F/m | ε", F/m | tan δ |
|---|---|---|---|
| 50 | 2.9 | 0.02 | 0.0069 |
| 250 | 4.8 | 1.00 | 0.2083 |

Design Integration Overview

The concept of the invention is based on a single energy source (MW energy), yet implements two distinct heating mechanisms: 1) direct coupling of the OPF material with MW energy launched from an open waveguide, and 2) absorption of excess MW energy by a susceptor that then provides further IR heating of the OPF material. The process is suitable for operation at atmospheric pressure. In most cases it is preferred to operate under conditions that are expected to produce a material that has the level of process of conventional LTC fiber. That is, Applicants prefer not to reach significantly higher temperatures, in order to keep the overall process of carbonization in two distinct steps; however, the invention may, in some cases, have the potential to the reach a temperature range characteristic of the lower end of HTC. It is acknowledged in the literature that the configuration of the fiber production process as two distinct steps is needed so that, among other benefits, the operator can apply different fiber tensions at LTC and HTC stages, respectively, and thereby generate a final product with desirable mechanical properties.

Note that a second energy source, viz., conventional heaters, may be used to elevate the temperature of remote parts of the apparatus to prevent the condensation of the fumes and the formation of tar in the cold areas. A background of 200° C. of those areas is normally sufficient. This second heat source does not contribute to the process of carbonization. Its sole purpose is to keep the equipment free of tar condensation.

The current example (for designs A and B) described here is designed to treat a minimum of 200k filaments, which corresponds to 4 or more tows of OPF (with 50k filaments each) simultaneously. This system comprises several subsystems, the most important ones being the following:

- an applicator with four waveguides with their individual ports and its conventional heating system (FIGS. 5-16);
- a MW generator with four ports of 1 kW each;
- a transmission line system which consists of four cables making the connection between each port of the generator and four individual adaptors; and,
- a control system (in this case operating under LabVIEW) that is used to centralize the control of the generator, of the fiber handling system, monitor the temperatures, and ensure a safe operation.

Ancillary subsystems, familiar in the industry, may include the following:

- a chilled water-cooling system;
- a nitrogen purge system with multiple ports;
- a fiber handling system with its ancillary equipment; and,
- a gas exhaust system.

The applicator comprises a single elongated cavity. The cross section of the cavity is typically rectangular, and its dimensions remain consistent from one end of the applicator to the other. The cavity is functionally divided into three continuous zones, although there is no physical delimitation between the zones, such as walls, eyelets, etc. Only the central zone receives EM energy through, typically, a set of waveguides. (The number of waveguides, preferably an even number, will be a function of the width of the ribbon of material to be treated; four waveguides were used in the current setup.) When four waveguides are used, two of these waveguides are connected to the flat upper side of the cavity, and the two others at its flat bottom side. The central zone further contains the susceptors that are used to elevate the temperature of the material to be processed. The two outer zones serve as MW dampers or chokes to reduce MW leakage to the outside. While some parts of the applicator are preferably warmed to prevent tar condensation (e.g., the processing cavity walls and the chokes), others may need to be cooled (e.g., the adaptors with their connectors, and the parts of the waveguides on which they are attached). The material being processed is driven by a conventional fiber handling system, in which the speeds of the feed reel and take-up reel are independently adjustable, so that by running the take-up reel at a slightly higher speed than the feed reel, a controlled amount of stretch is applied to the fiber during processing as is well known industry practice. The material propagates in and out of the applicator through sets of adjustable flanges located at both ends of the cavity. The process is purged with nitrogen or any other suitable inert gas mixture through six ports, one on each wave guide, and one on each flange. On the waveguides, the nitrogen inlets are located at the junction between the waveguides and their holders, FIG. 6. The off-gassing is collected by a main hood that covers the entire applicator. The entire system and the safety probes are controlled and monitored by computer, using a National Instruments LabVIEW human machine interface (HMI).

Example

Figure 5:
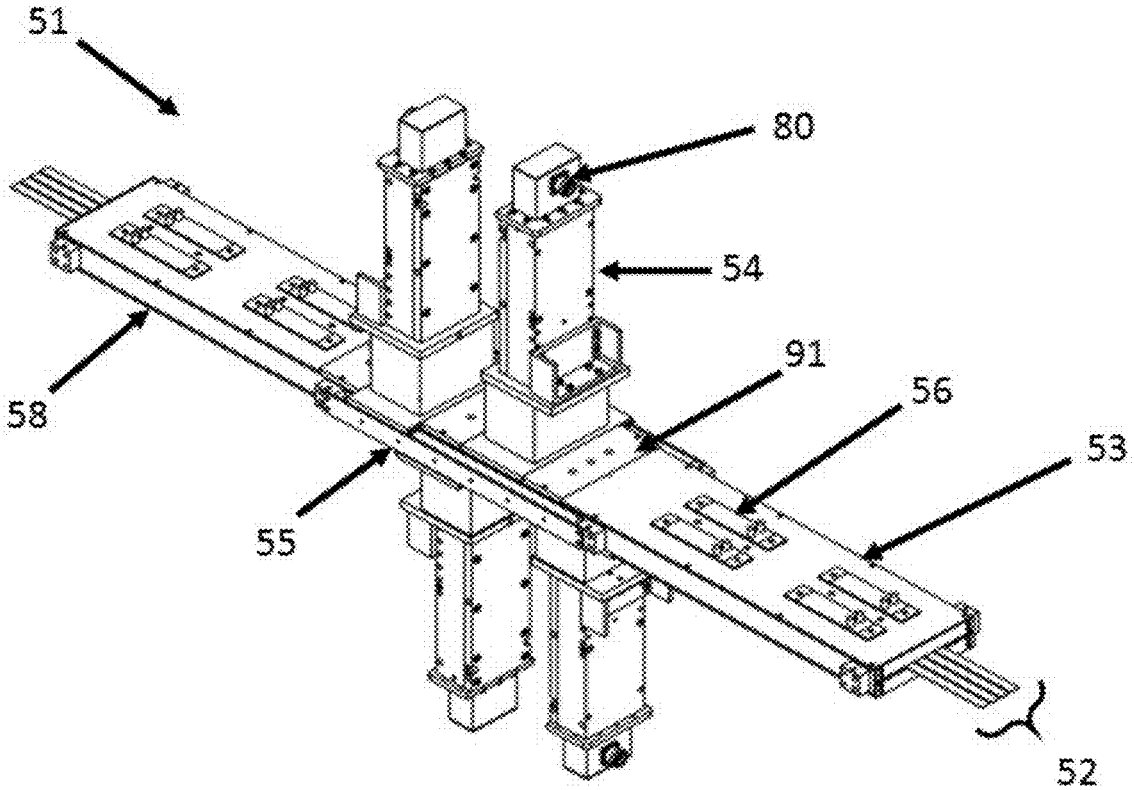
FIG. 5 is a perspective view of a closed applicator and microwave power connections in accordance with some aspects of the invention.

FIG. 5 presents a schematic perspective view of the applicator 51. Four tows 52 are represented, arranged in parallel on the horizontal part 53 of applicator 51. The horizontal part of the applicator is divided in three internal sections (no division is visible in this view): two damper (choke) sections for safety (on each end) and the furnace area for the process (in the center). The four vertical waveguides 54 are mounted to the central furnace section only. The device has two main sources of energy: (1) the main electromagnetic power (preferably ISM band), responsible for 100% of the process energy, is supplied through dedicated connectors 80 located at the end of each waveguide 54, (2) the regular power (120 V) to energize an ancillary heating system consisting of a set of eighteen 250 W power strips laid on the lateral sides of the furnace section, for two of them 55 (optional), and on the top and bottom surfaces of the damper sections (chokes), for the sixteen others 56. As previously noted, the role of the power strips 55, 56 is to prevent condensation of the tar in the vessel. Their thermal contribution to the process is negligible. Since it is set to operate anywhere between 200° C. and 250° C. In this given temperature range, the OPF (feedstock material) is quasi-stable, e.g., no reaction occurs. The configuration of 18 strip heaters of 250W each, i.e., a total of 4.5 kW, is simply adequate to raise the prototype to the temperature specified above, including the material used for its construction (aluminum) and the surrounding insulation (100 mm of rockwool), within the expected ramp time. Once the process value reaches the set point, the system is duty-cycle controlled. A powerful heating system will operate at a low duty cycle. A modification of this configuration will have limited to no impact on the process as long as all parts of the applicator subject to tar accumulation can reach 200° C. or more. Downsizing this ancillary heating system and/or the outer insulation might mostly impact the ramp rate and the duty cycle. An under dimensioned heating system might allow reaching 200° C. on the entire surface of the device, leaving parts of the system susceptible to tar accumulation. This would create eventual clogging, preventing proper operation of the entire system.

Example

Figures 6A, 6B:
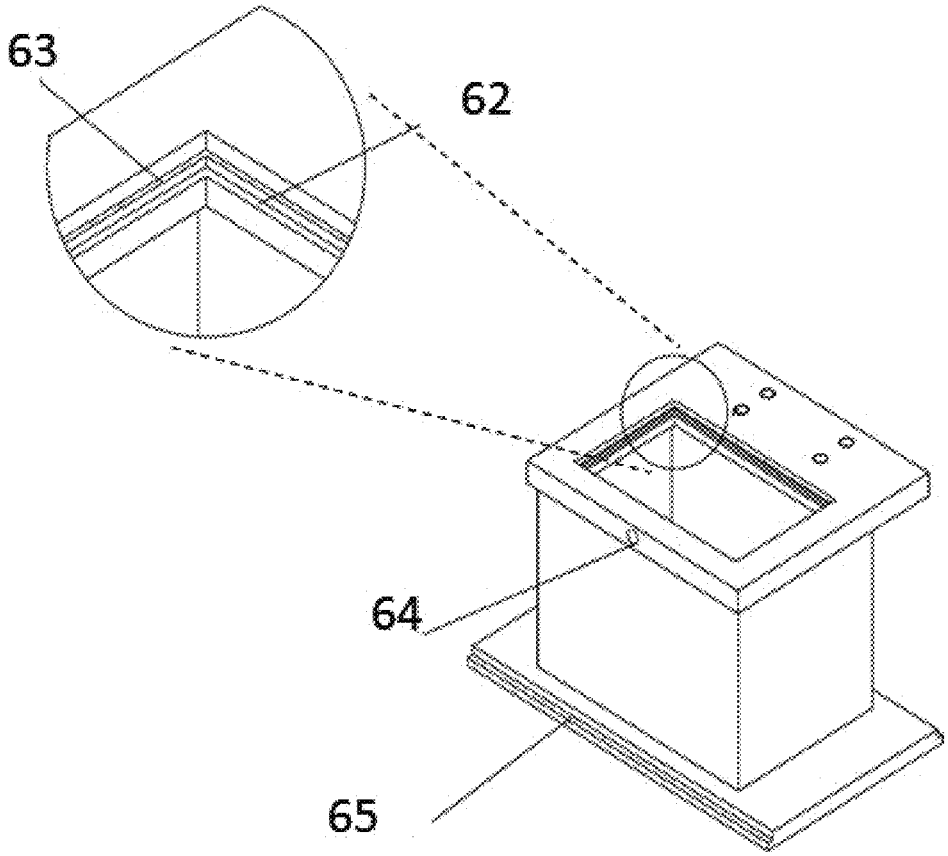
FIGS. 6A-B present views of a waveguide standoff of an applicator in accordance with some aspects of the invention, where

FIG. 6 illustrates a waveguide standoff 61 to allow sliding vertical and limited side motion to the waveguide. A first channel 62 is designed along the inner junction surface between the sliding waveguide and its standoff to receive an EM shielding gasket. The nitrogen purge of the entire system is done by ports 64 set on the side and is delivered through a second parallel channel 63 machined on the same surface as channel 62. A clamping ledge or flange 65 is provided on the edge of the basal plate, facing the applicator cavity 53. This ledge also contributes to the safety of the device regarding potential leakage of EM radiation through the junctions of the components.

Example

Figure 7:
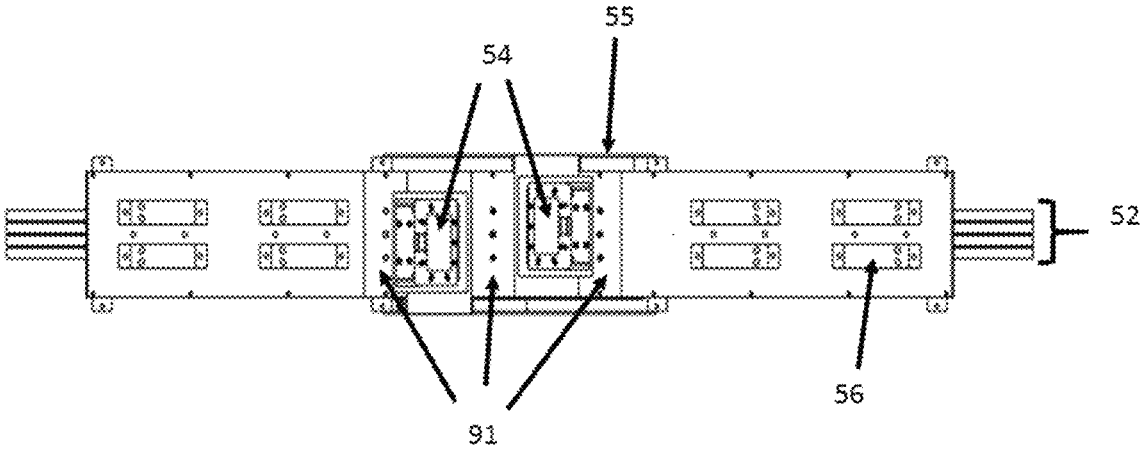
FIG. 7 presents a top view of an applicator cavity in accordance with some aspects of the invention.

FIG. 7 presents a top view of the applicator 51. The total length is 1.5 to 2 m. The central section, where the waveguides are located, is limited to approximately a third of the total length of the device. The rest of the device comprises damper sections (chokes) on both ends. The waveguides 54 are off-centered in order to cover the width of the four represented tows 52.

Example

Figures 8A, 8B:
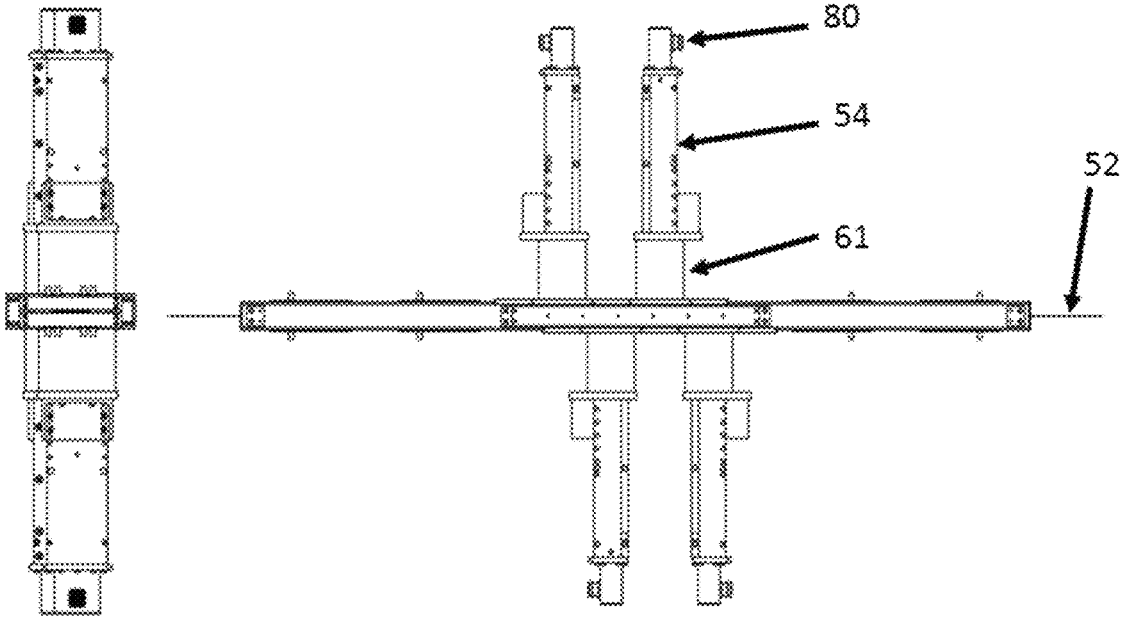
FIGS. 8A-B present a front view (FIG. 8A) and a side view (FIG. 8B) of an applicator cavity in accordance with some aspects of the invention. The fiber tows pass horizontally through the center of the applicator.

FIG. 8 presents front, 8A, and side, 8B views of the applicator 51.

Example

Figure 9:
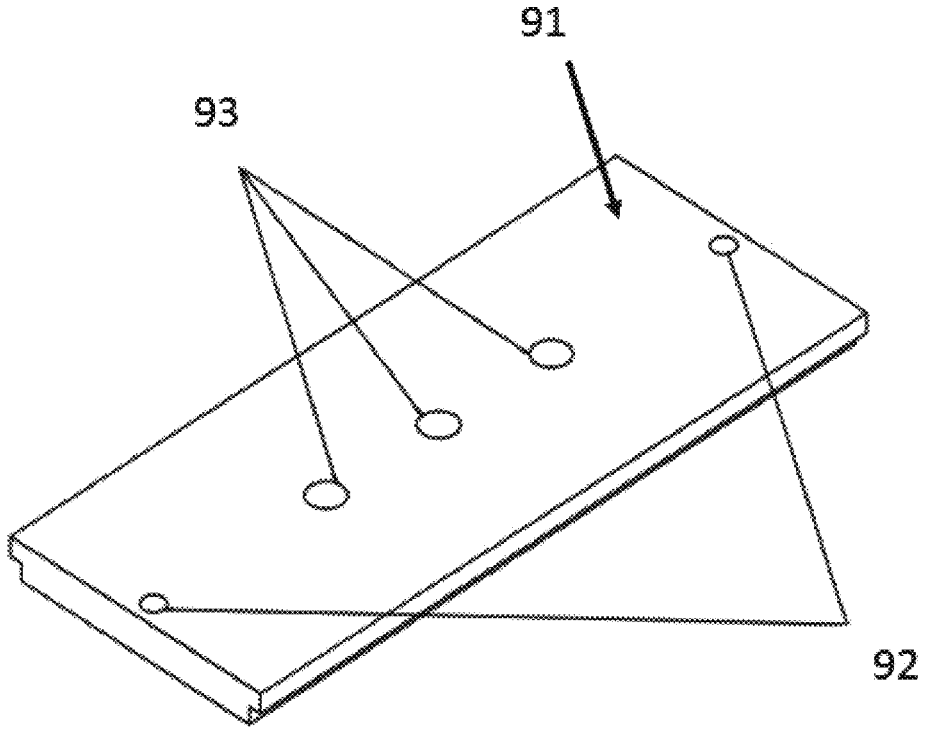
FIG. 9 presents a perspective view of a clamping plate in accordance with some aspects of the invention.

FIG. 9 shows one of the six clamping plates 91. These plates are used to maintain the waveguide standoffs 61 in compression against the side rails. Each plate has two mounting holes 92 and three thermocouple ports 93.

Example

Figure 10:
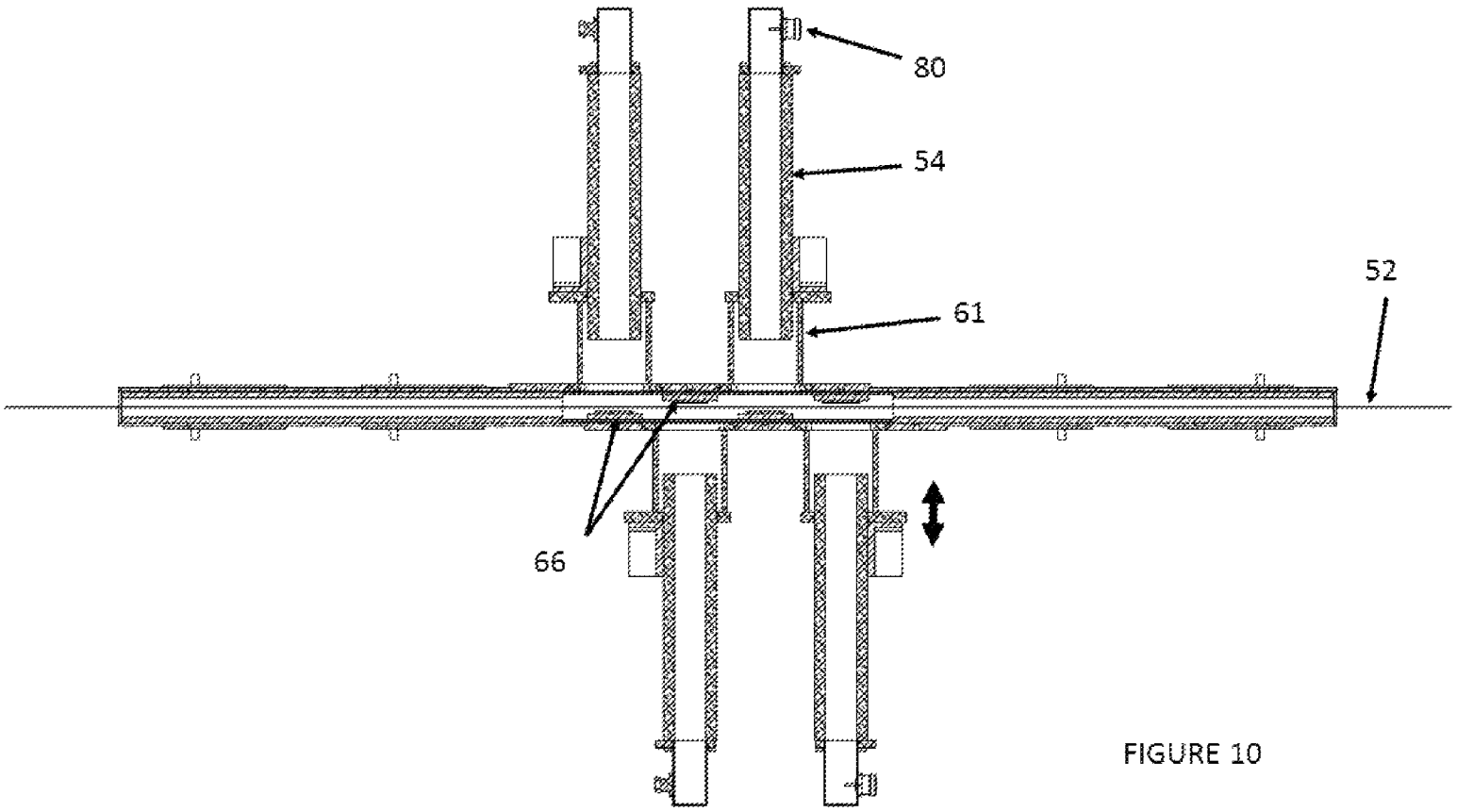
FIG. 10 presents a side view in cross section of an applicator in accordance with some aspects of the invention.

FIG. 10 presents a side view of applicator 51 in cross section. The position of each of the four waveguides 54 are adjustable along the vertical axis within their respective standoffs 61 by about one wavelength (indicated by the double arrow). The four susceptors 66 are individually located in the near field region facing the termination of each waveguide 54. The tows 52 are traveling between the waveguides 54 and their associated susceptors 66.

Example

Figures 11A, 11B:
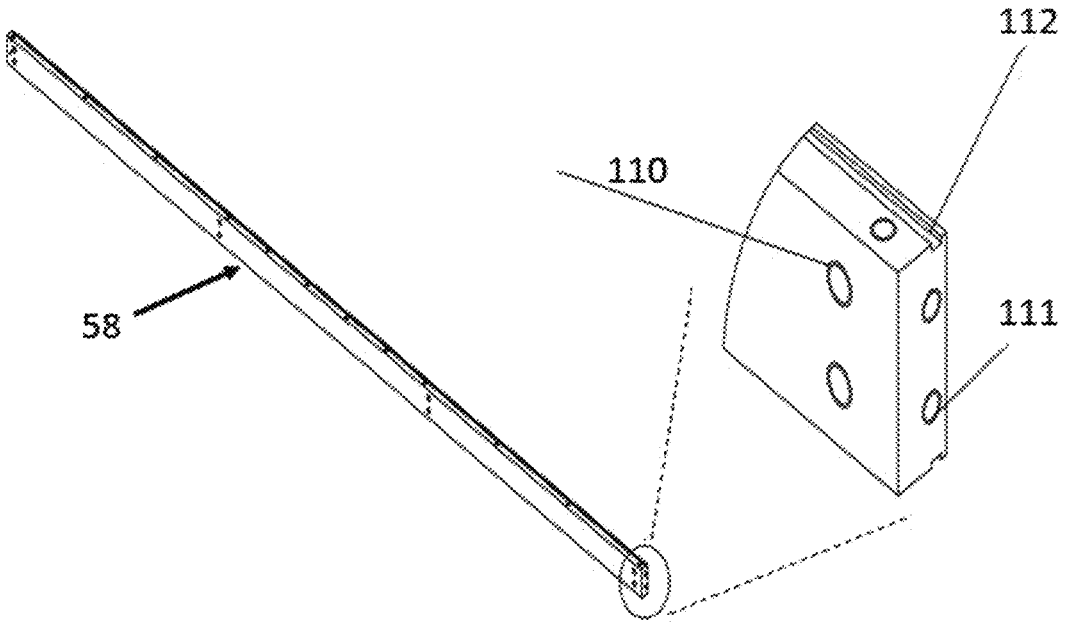
FIGS. 11A-B present a perspective view of a side rail of an applicator in accordance with some aspects of the invention.

FIG. 11A shows one side rail 58 of applicator 51. Structurally, the two side rails are the most important part of the applicator because the majority of parts are bolted to them. They also define the length (1500 to 2000 mm) and the inner thickness (20 to 100 mm) of the cavity. The dimensions are chosen as a function of the frequency band of operation and the amount of material to be processed. Detail FIG. 11B shows several features of the side rail, including mounting holes for external support brackets 110, mounting holes for adjustable end flanges 111, and a channel or groove 112 to accommodate EM shielding gasket material.

Example

Figure 12A:
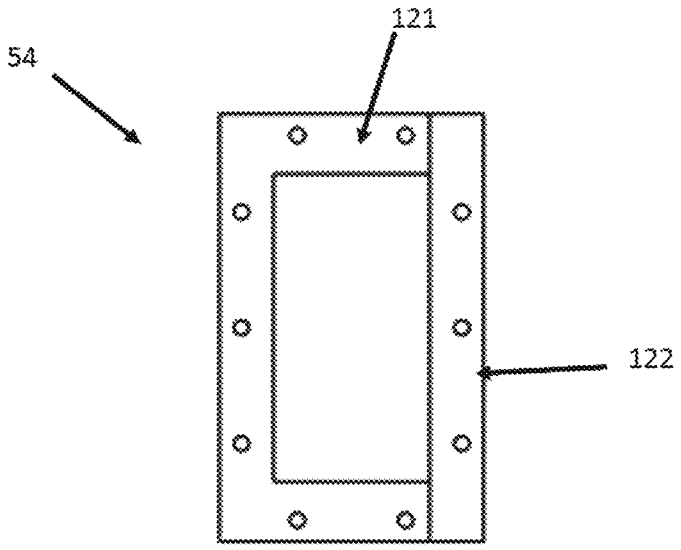
FIGS. 12A-B present a top view (FIG. 12A) and exploded view (FIG. 12B) of a waveguide in accordance with some aspects of the invention.
Figure 12B:
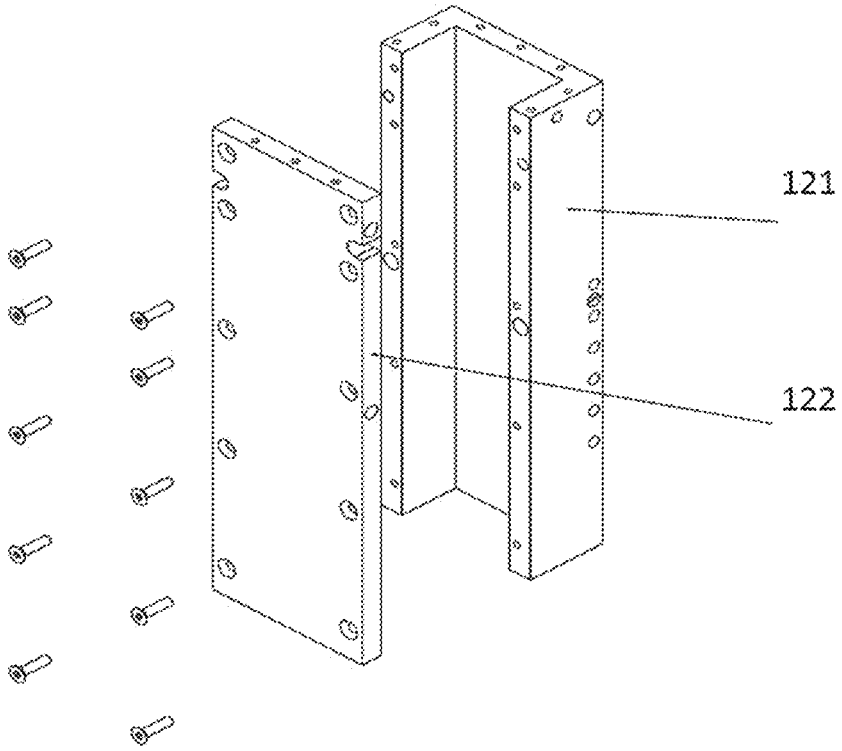

FIG. 12A shows a top view of the assembled waveguide 54 and FIG. 12B shows an exploded view of the same waveguide. This particular guide is made of two custom blocks that are bolted together, however it will be appreciated that rectangular waveguides may be made by many suitable fabrication methods as are well known in the art. Block 121 is made of a solid block that has been milled to a "U" shape; block 122 is a flat plate, in this example 8 to 15 mm (0.315 to 0.591 in) thick. The resulting inside dimensions will typically be based on standard commercial waveguides. Other dimensions, for inner guide, wall thickness, or overall length can be chosen for particular applications. It will be understood that some dimensions will be dictated by the selected frequency of operation, whereas others (e.g., wall thickness) may be independent of operating frequency.

Example

Figure 13:
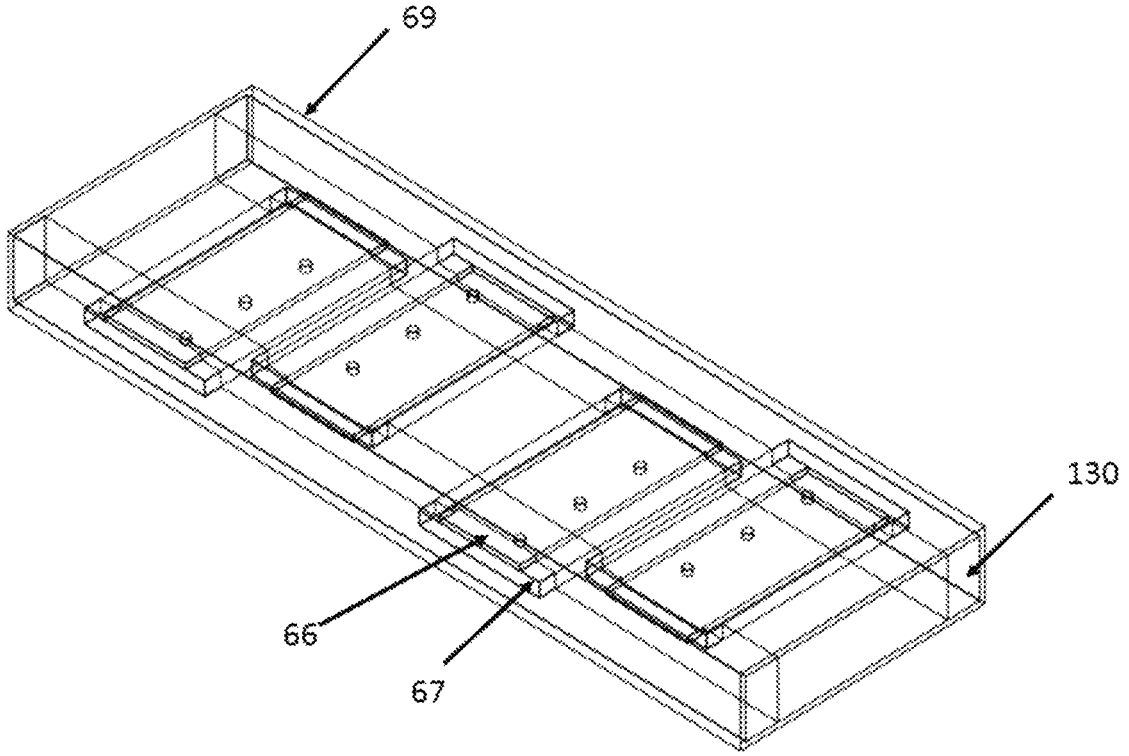
FIG. 13 presents a perspective view of a furnace section showing four susceptor plates supported by insulating blocks and enclosed in a quartz sleeve in accordance with some aspects of the invention.

FIG. 13 is a perspective view of the furnace (central section of the applicator 51). The four susceptors 66 are alternatively connected top and bottom on their respective blocks of insulation 67. They are typically spaced at one wavelength from each other (center to center) thanks to lateral insulation blocks. The whole system can be embedded inside a rectangular sleeve 69 preferably made of quartz or any EM transparent material at the temperature of interest. In this case, for temperature measurement, a quartz sleeve typically with 12 bore-through holes for three 3.2 mm (⅛ in) OD thermocouples with contact on the back of each susceptor was used. The number and dimensions of the thermocouples are not restricted to any particular values.

Example

Figure 14A:
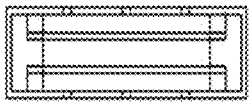
FIGS. 14A-B present an end view (FIG. 14A) and side view in cross section (FIG. 14B) of the furnace section shown in FIG. 13 in accordance with some aspects of the invention.
Figure 14B:
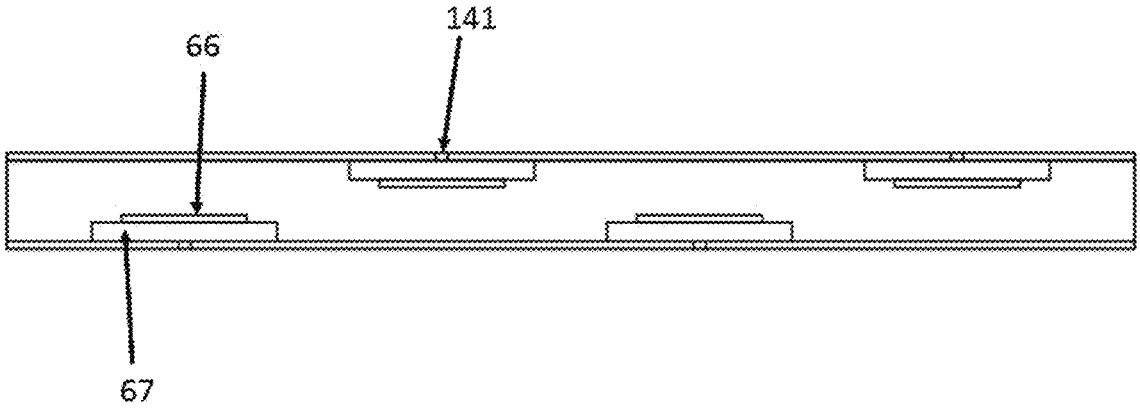

FIG. 14 shows an end view 14A and side view 14B of the assembly of four susceptors 66 embedded in the quartz sleeve 69. The bore through holes 141 in the quartz sleeve are visible. The thermocouples are not shown.

Example

Figure 15:
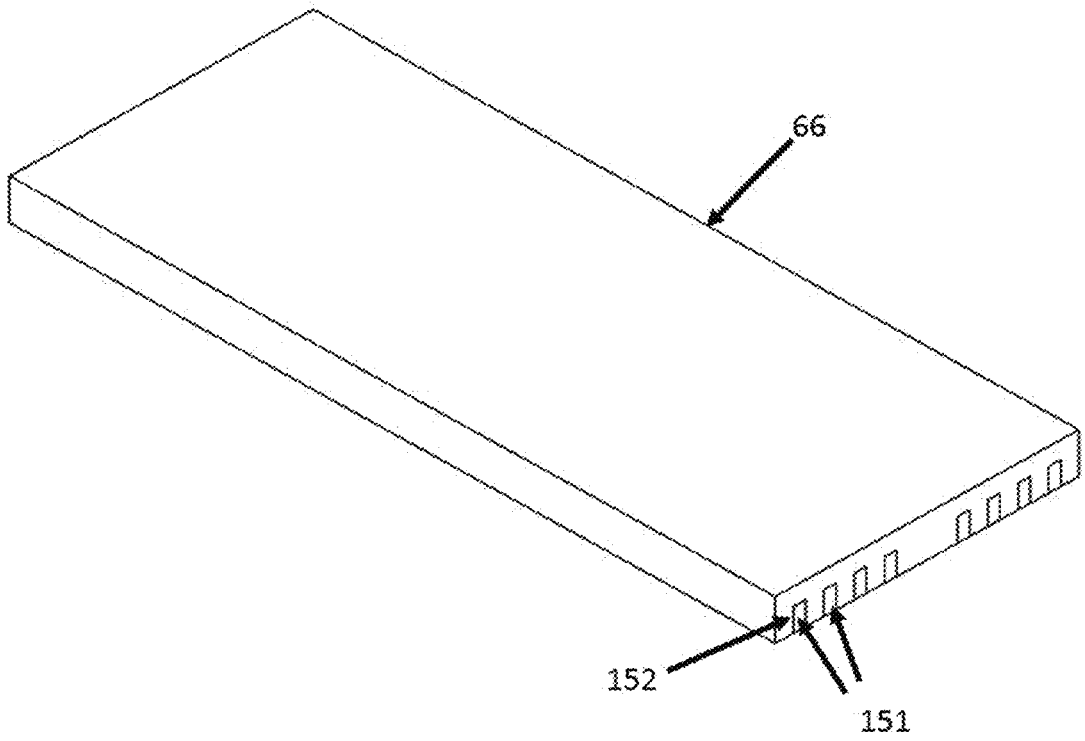
FIG. 15 presents a perspective view of one susceptor plate in accordance with some aspects of the invention. Channels on the back side are filled with thermally conductive material.

FIG. 15 is a perspective view of one susceptor 66 as fabricated. Dimensions are normally driven by the frequency band of operation and the corresponding dimension of the cavity. For example, in one configuration, the dimension of each susceptor is 100 to 280 mm long×20 to 100 mm wide×2 to 15 mm thick. The top is a flat surface that faces the fiber tow 52 and the opening of waveguide 54. The back of each susceptor has a set of grooves 151 (in this case eight), each ~1 to 2 mm wide and ~2 to 14 mm deep. Each groove contains copper or other highly thermally conductive material 152 to help heat transfer across the length of the slab for better uniformity. The area in the center of the plate contains no grooves in order to provide a flat contact area for the thermocouples. The number and configuration of grooves depicted is this figure is only an example. The dimension, direction, shape of the pattern, shape of the trace cross section, or space between the traces can be modified for particular applications. The pattern could allow for the copper traces to intersect each other, or they could be interconnected by a back plate made of a thermo-conductive material that meets the temperature requirements (for example, a copper plate). This system could be built or extruded like a heat sink (e.g., a pattern of fins connected or welded to a support plate).

Example

Figure 16:
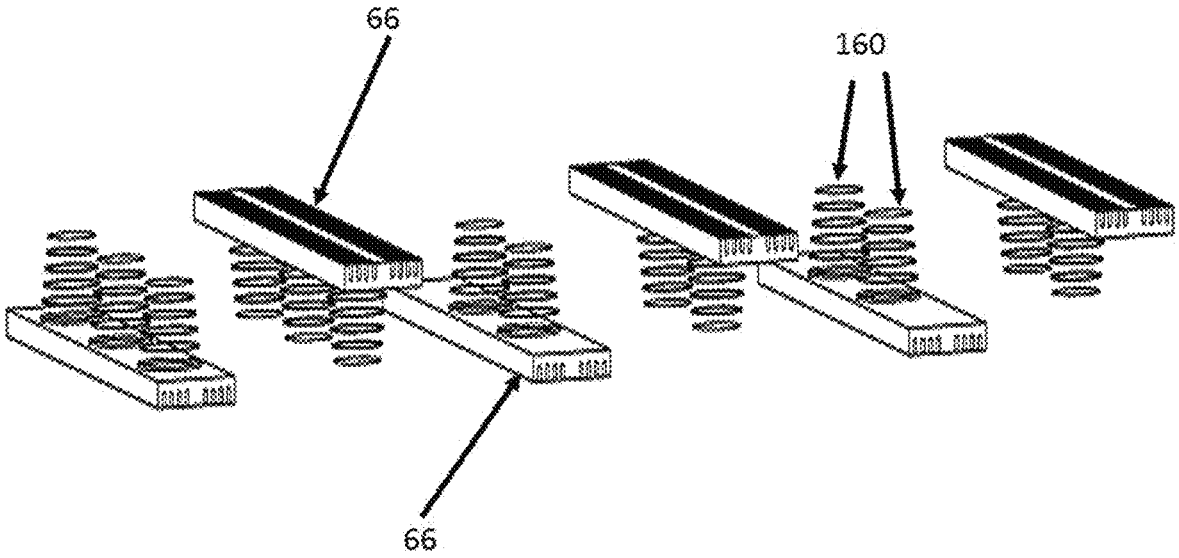
FIG. 16 shows schematically an arrangement of multiple treatment sites in a scaled up version of the system, "design (C)" in accordance with some aspects of the invention.

FIG. 16 illustrates schematically a perspective view of the susceptor arrangement of design (C). A wide band of fiber, not shown, travels from left to right, though the direct exposure of EM. The susceptors 66 are perpendicular to the propagation of the fiber and their length is slightly wider than the band of fiber. The EM energy 160 is delivered to the fiber and the susceptor with a system of waveguides or slotted waveguides. In this example, a total of fourteen waveguides and six susceptor plates would be employed, and two or three waveguide openings may share a common susceptor plate.

Description of the Subsystems.

The Applicator.

One suitable applicator is a rectangular cuboid channel offering a single cavity with inner dimension 150 to 300 mm×20 to 100 mm.

The central zone of design (A), where the process happens, contains a rectangular quartz insert that is a close fit with the cross section of the cavity as shown generally in FIG. 10. The quartz insert, if used, may be 457 mm long (18 in). It contains a frame 130 that maintains the susceptors in fixed position, FIG. 13, and protects the waveguides from heat and tar contamination. The frame is made of insulating low density alumina blocks that are transparent to the MW. It is shaped somewhat like a "ladder" where the "rungs" are the parts holding the susceptors. Each susceptor is affixed to an individual insulation block by a locking system similar to a tongue and groove joint. The frame (or "ladder") can conveniently slide in and out of the quartz insert when pulled outside of the cavity, e.g., when maintenance is needed. If no quartz sleeve is used (design (B)), the frame has to be slightly modified: it will more look like a channel rather than a "ladder". However, the locations of the susceptor will be unchanged and the outer dimensions of the frame may have to be adjusted to fit the cavity of the applicator.

The susceptors are blocks made of one or more lossy materials, preferably with heat conducting or spreading features in the volume or on the face that is not directly exposed to the EM energy (preferably the back side, the one that is opposite to the wave guide, as shown generally in FIG. 15). The choice of the lossy materials is based on the value of the permittivity over the frequency band and temperature of interest. Applicants prefer a material with tan $\delta$ of at least 0.04 and more preferably, at least 0.06. For the current example, Applicants chose nitride bonded silicon carbide (SiC) for its cost and availability, but other materials could be selected provided that their structural properties, loss factor, and thermal conductivity are acceptable at the temperature range of interest. The shape of the block can be a tile, or any other shape. Applicants prefer rectangular prismatic tiles for their simplicity and easy scalability. Hence this particular shape is the one that was evaluated in Applicants' test program. The tiles are typically oriented crosswise relative to the propagation of the fiber, and as close as possible to the fiber tow.

For this application, SiC based ceramics are particularly interesting because they are among the ceramics with the highest theoretical heat conduction, approaching the 200 W/m K of aluminum. This property is highly desirable because it prevents hot spots and sharp thermal gradients and thermal treatment discrepancies across the width of the fiber tow. However, the selection of this particular ceramic is not straight forward. In addition to having more than 200 crystalline forms, a large variety of SiC is available on the market. Each product on the market is different because of the manufacturing process, grain size and composition. Consequently, a large variation of the material and its properties, including the thermal conductivity and dissipation factor can be found. As a result, a given SiC may not reach theoretical expectation. Some materials could offer half or less of the expected thermal conductivity. Furthermore, these properties are usually lower at high temperature. Like most ceramics and metals, SiC-based materials' thermal conductivity typically drops around 40% to 50% towards the upper end of its service temperature rating, increasing the risk of temperature non-uniformity by a comparable order of magnitude. In any case, the skilled artisan can determine suitable materials and dimensions for a particular application through routine experimentation. For example, a suitable volumetric fraction of SiC could be dispersed in a thermally conductive ceramic matrix such as BeO or AlN to provide a combination of high dielectric loss and high thermal conductivity.

Given the above considerations, the susceptor material should be selected and designed based on the following criteria:

1. The selection of material of construction with high thermal conductivity and high loss factor is preferred. The selected material should also be stable at high temperature, in oxidative and non-oxidative environments. Some ceramics can satisfy those three specifications, but carbonaceous materials, such as graphite, might offer substantially higher thermal conductivity. However, carbonaceous materials might not be isotropic and might be unstable in an oxidative environment, bringing a risk of degradation of the hardware in a hot oxidative environment (in the case of accidental discontinuation of the inert gas purge). Because of its anisotropy and its instability at high temperature in an oxidative environment, carbonaceous materials might be disqualified in favor of ceramics, especially SiC-based ceramics for this type of application at larger scale.
2. The insertion of a heat spreading structure added to the blocks of the lossy ceramic as shown generally in FIG. 15 may increase its thermal conductivity. Grooves or bore-through holes filled with a material having a high thermal conductivity can be used for this purpose. In one design, copper is added on one side of the ceramic. The use of copper in the construction of the susceptor will limit its operating temperature to ~1050° C. This temperature limitation is well above the temperature range of operation for LTC. 3. Applicants have found that it is preferable to place insulation around the susceptor to mitigate the heat loss through the covered surfaces. Insulation helps to maintain a more a homogeneous temperature across the volume and the side of the susceptor facing the fiber to be treated. In various tests, Applicants have found that there is normally some temperature variation across a susceptor plate, e.g., 100° C. or more when the average plate temperature might be in the 500-600° C. range.

It will be appreciated that the invention may employ a single waveguide and susceptor plate, particularly for sample batches or laboratory research. For larger scale processing it is helpful to employ waveguides in sets, typically pairs, and in that case the waveguides are mounted on each side of the central zone of the applicator as shown generally in FIG. 8 using an individual standoff system, FIG. 6, that allows a vertical and lateral adjustment for positioning. As shown on FIG. 7, the standoffs with their respective waveguides can be off-centered, which permits adjustment of the EM radiation pattern on the material. The standoffs are held into position by clamping against the frame. The clamping may be done with six short rectangular "clamping plates" (FIG. 9). These rectangular plates are bolted to the side rails at fixed locations and have three functions:

1. Waveguide positioning: the distance between the waveguides is set by the width of these plates. These are designed to be easily replaced to enable the user to adjust the waveguide distance.
2. Structural: by closing the gap between the pair of waveguides and between the waveguides and the four damper covers, they also contribute to structural integrity.
3. Temperature measurement: each of those plates have bore-through ports holding the thermocouples reading the temperature of the back of each susceptor.

Fabrication of the Cavity.

Applicants chose aluminum for its machinability, knowing the temperature of the walls of the cavity would not exceed 600° C. Other alloys, such as stainless steel, copper, or brass, might be preferable for some parts such as the waveguide system. If the invention is intended to operate at higher temperatures (e.g., in the HTC range) then replacement of aluminum by higher-temperature alloys will be indicated.

The main cavity is a flat horizontal rectangular elongated tunnel. For the construction, two parallel machined bars (or "side rails") going from end to end of the cavity constitute the main structure of the assembly. These have grooves to receive copper gaskets at all seam/joint locations with other parts (FIG. 11) to prevent EM radiation leakage. Rectangular plate or waveguide stands are bolted along these two rails, forming a rectangular channel.

The waveguides are fabricated to accommodate the geometrical and thermal constraints. They were fabricated from solid blocks of aluminum milled to obtain a "U" shaped member with a solid wall of 15 to 25 mm thickness (FIG. 12). The U-shaped members are closed with flat aluminum plates of 5 to 25 mm thickness. Extra thickness allows for the following functionalities:

1. Adjustability: the thickness allows drilling multiple tapped holes for a high degree of adjustment thanks to a system of fasteners.
2. Flange mounting: an adapter can be bolted on one side and a window of transparent material (such as fused quartz or other) on the other side. A system of windows can be used at the termination of each waveguide as a replacement of the quartz sleeve. The goal is to keep the waveguide system free of off-gassing and condensation.
3. Thermal management: holes may be drilled along the side of the wall in the close vicinity of the adapter for cooling water circulation. Other similar holes may be placed along the waveguide in order to remove some material and limit the heat transfer from the hot chamber to the cooling system at the far end of the waveguide. Stainless steel may be preferred for this part because it offers a thermal conductivity approximately ten times lower than aluminum. However, costs and weight of the parts might make aluminum preferable for this setup.

The clamping plates are typically 120 to 250 mm long×50 to 100 mm wide×2 to 15 mm thick. They are the only structural parts that are preferably made of stainless steel. This alloy is preferred over aluminum for its higher stiffness at elevated temperature. One of their functions is to hold the waveguides in position. On the lower side the plates must support the entire weight of the two waveguides (all waveguides are clamped, not bolted). These plates are perforated to allow spring loaded thermocouples to probe the susceptor. They also act as a fixed distance spacer for the waveguide. Hence, the distance between the waveguide can be changed by replacing those plates with other plates of different dimensions.

The Dampers.

The overall length of the rectangular tunnel defined by the side rails is typically 850 to 1350 mm, of which the actual processing cavity is only about 400 to 650 mm long. The remaining length is evenly split into two damper sections, one damper at the entrance of the process and the second at the exit. They are designed to dissipate the EM energy that escapes the central processing zone, thereby acting as microwave chokes to minimize EM emissions to the outside. These dampers make the system safe and potentially allow it to meet FCC leakage requirements in frequency regions outside of the traditional ISM bands.

The dampers are built as follows:

1. They are straight extensions of the processing cavity (same cross section of 150-300 mm×20-100 mm). Their frame is shared with the processing zone by using the side rails (58 in FIG. 11) as their main structure. They are closed with large plates made of aluminum on the top and bottom.
2. They are lined with nitride bonded SiC tiles of 2 to 15 mm thickness along the top, bottom, and side walls.
3. Sets of four strip heaters of 500 W each are attached on each large plate (shown at 56 in FIG. 7). Their function is to prevent the condensation of fumes inside the dampers by setting a temperature background of 250° C. They are connected to an independent power supply. They do not contribute significantly to the process heating. Each damper has its own heating system, with its temperature controller and over-limit controller.

Concept of the Applicator.

The concept of this applicator is to expose the fiber, at atmospheric pressure, directly to the EM energy in the near field region of an open waveguide and then absorb and re-radiate energy that was not absorbed by the first pass through the fiber tow, using a high-loss susceptor plate placed on the opposite side of the fiber tow and facing the waveguide opening. The susceptor has several functions:

1. Elevating the temperature of the fiber. Previous work showed that the OPF does not couple with the microwave energy at low temperature (see FIG. 2).
2. Limiting the propagation of the non-coupled energy along the cavity. This mitigates the interferences with the other ports (low $S_{2,1}$).
3. Spreading the heat across the width of the process cavity, for better process homogeneity.

The Generator and the Transmission Line.

In this work, Applicants used a solid-state generator (Model PTS Precision Power manufactured by Cellencor, Inc., Ankeny, IA), with an operating frequency range of 2.4 to 2.5 GHz, which is in an ISM band. This power supply was selected for the following reasons:

1. High accuracy and the narrow bandwidth of operation of this type of generator is particularly beneficial for this process that shows pseudo periodic variations of $S_{1,1}$ of 5 to 15 dB every 20 to 30 MHz. Solid-state generators typically have the capacity to select a band of frequencies with a return loss as low as −20 db, or better.
2. It is possible to operate multiple ports (up to four ports in the present case), with individual control of the power (up to 1 kW), phase angle, and frequency of operation.
3. Reliability: the life expectancy of magnetrons can be substantially affected by the operating conditions, and rarely exceed one year under continuous operation. Furthermore, the life expectancy of a magnetron can be shortened by random failure. On the other side, the newer solid-state technology shows higher reliability with 10× longer life expectancy. This type of device is more adapted for continuous production.

The transmission line is the subsystem that connects the generator to the applicator. In the current case, high power cables are used to connect each port of the generator to conventional coax-to-waveguide adaptors fastened at the input end of each waveguide. A circulator is not needed because the generator is capable of measuring $S_{1,1}$ and tripping when the reflection exceeds a safety limit.

It will be appreciated that many other configurations are possible for the construction of the transmission line using routine engineering principles. Ideally, a full solid waveguide solution is preferable. The choice of the transmission line is mostly driven by the following considerations:

1. Impedance and insertion loss of each element.
2. Power rating at the frequency band of interest.
3. Management of the reflected power using appropriate equipment, such as circulators, dummy loads, or other familiar components.
4. Thermal characteristics of any hardware that might be connected to components that will get hot during operation.

In the setup disclosed herein, the transmission line is not in direct contact with hot parts: they are safeguarded by a cooling system that prevents the adaptors and the connectors from melting.

Tuning of the System.

As in any EM operating system, the tuning of the system is a critical aspect that must be satisfied. With an appropriate design of the setup, and if all impedances are matched, the return loss ($S_{1,1}$) can be as low as −25 dB. Optimizing matching while getting an appropriately high EM field pattern in the cavity can be optimized by using a computing electromagnetic modeling system (CEM). Despite several approximations, the model can help in defining the dimensions of the cavity and setting the dimensions and position of the susceptors.

On the physical setup, the value of the tuning can be controlled with a vector network analyzer (VNA). When properly set, the tuning can be as good as between −16 and −22 dB during the process. Usually, the four ports do not return identical values for $S_{1,1}$, but they are all either good or, at least, acceptable.

During a process transition, when the temperature is going up, the optimal matching frequency may have a trend of dropping by few MHz. As long as the band of lower reflection remains in the band of the power supply's operation, it is possible to adjust the frequency delivered by the generator to match with the new frequency. This enables the operator to maintain a low reflected-power condition during transient operation. Once at steady state, the band of lower reflection remains stable.

Pattern of Radiation.

Because the fiber tow and susceptor lie in the near-field region of the waveguide opening, the pattern of radiation is mostly concentrated on a circular region of ~30 mm in diameter at the outlet of each waveguide. The offset of the waveguides and their alternate top-bottom positioning allows uniform treatment of both sides of a band of multiple tows up to 70 mm wide in total.

Fiber Delivery.

It is important to have a fiber handling system able to deliver multiple tows of fiber with a good spread and under a controlled tension and trajectory. The tow band in the cavity must travel through the regions of high EM field intensity. Furthermore, the fiber must propagate between the set of susceptors, preferably leaving less than 5 mm above and below the tows with the current geometry, while avoiding direct contact between the moving fiber tows and the susceptor plates. Fiber handling systems are well known in the art of carbon fiber manufacturing, and the skilled artisan can readily adapt such systems and principles to particular process configurations. It will be understood that the thickness of the fiber tow itself will depend on the type of fibers, the diameter and number of fibers in the tow, and how effectively the two is spread laterally as it passes into the system. To avoid any contact between the fiber tow and the fixed components, Applicants prefer that the gap between the waveguide opening and the susceptor plate be a minimum of 2 mm and preferably 5-10 mm. To maintain near-field conditions, Applicants contemplate that the maximum gap between waveguide and susceptor should be kept to less than the wavelength of the EM energy being used, and more preferably less than one-half the instant wavelength.

Control System.

The set-up is controlled by a LabVIEW software interface which is piloted from a regular computer. This software, used as an HMI, is provided by National Instrument and has been selected for its high configurability. The computer is connected to a RIO that is itself connected to most of the ancillary equipment. To control the setup, three major screens were designed. Each of those screens have one of the following functions: "Control System", "Thermocouple monitoring", and "Fiber Handling System Control". The "Control System" screen is the main HMI and allows to control the status of most of the ancillary equipment that is not directly connected to the applicator. Its main function is to ensure proper operation and safety. Safety equipment includes: E-stop buttons, HCN and RF radiation safety probes.

The "Thermocouple monitoring" is a screen dedicated to track temperature fluctuation within the system. More specifically, the applicator has 12 thermocouples distributed throughout as a set of 3 per susceptor. Each of these thermocouples is monitored through this screen.

The last screen, "Fiber Handling System Control", pilots the rollers that drive the material through the applicator. It also sets the mechanical stretch applied to this material.

Note that some ancillary equipment or systems are not connected to the control system, such as the conventional heating system (which operates with independent thermocontrollers), the take up winder (that operates autonomously with a self-speed adjustment), or the exhaust system.

This allows for control over the stretchers and exactly how much stretch they are applying to our product. There are connection lines and cables running between pieces of equipment. One example would be lines running from our cooling system which is tied into our generator. We use a purely mechanical creel that is not connected to any software or control system, a more advanced piece of machinery could be implemented. The winder in use is autonomous. An exhaust system and oxygen probe is in place, but they are not connected to the system. Thermocouples located on the applicator are used to measure the temperature of the back of the susceptors.

Processing Experiments and Results.

This section presents a series of results obtained with the system previously described and illustrated as design (A), which has the rectangular quartz sleeve. Designs (B) and (C) are not tested. All testing was completed with equipment designed to operate in an ISM band (2.4 to 2.5 GHz). The results may vary with the dimension of the equipment and its frequency of operation; the skilled artisan will appreciate that the physical dimensions of most microwave or RF components will scale with frequency in a well-understood way. For simplicity, the present invention was restricted to this band of operation in the following examples, but the overall inventive principle is not limited to any particular frequency.

The following examples are based on the continuous process of feedstock consisting of multiple 50k filament tows of industrial grade oxidized fiber PAN with a density of 1.37 g/cm$^3$. This oxidized material is subjected to treatment as described to become carbonized fiber (carbon fiber) using the present invention. The first example shows mechanical properties of both LTC fiber and its subsequent HTC fully carbonized fiber. The second example presents density measurements of 4 and 7 tows simultaneously processed at LTC using 3 residence times. Finally, the third example shows the evolution of the density of 7 tows simultaneously processed at LTC over a wider time span. This last example illustrates the performance and limitation of this invention with the current design.

All processing was done in an inert, i.e., nonreactive and non-oxidizing, atmosphere, in this case nitrogen. It will be understood that other inert gases will also be suitable, and that industrial gases are never completely free of impurities. The carbon fiber industry generally recognizes that a gas may be regarded as non-oxidizing if the oxygen content is less than about 50 ppm. Applicants used a supply of nitrogen that met this standard.

As a reference, a conventional LTC process with comparable temperature setting provides a density of ~1.56 g/cm$^3$.

Example

In this example, four tows were simultaneously processed. Only continuous processing was considered. A density equal or greater than 1.53 g/cm$^3$ with 2.8 kW of EM power can be achieved with a residence significantly shorter than 1 minute. Four tows coming out of the LTC process are continuous samples of pristine (damage free) material. Afterward, each of the four tows is individually carbonized at HTC in a conventional tubular furnace. Table 2 shows mechanical properties before and after full carbonization (LTC performed with the present invention and then HTC using a conventional tubular furnace). The following was observed:

The density of the LTC material is strongly dependent on the residence time.

The process is not perfectly consistent across the width (Tow A and Tow C are almost evenly processed, Tow B is the most processed, and Tow D is slightly less processed than Tow A and B). The deviation in width is reduced with the reduction in residence time.

The process provides consistent mechanical property along a given tow on the final product.

LTC material systematically showed better mechanical properties with the longest residence time.

The mechanical properties of the LTC fiber are strongly correlated to the degree of processing. The most processed fiber provides the strongest mechanical properties (tensile strength and modulus). The degree of processing is evaluated with the density. The strain at break follows the opposite trend. It drops with the degree of processing, which is expected, based on results observed with the conventional process.

Based on this dataset, there is no clear correlation between the residence time, nor the progress of the process at LTC and the mechanical properties of the final product after conventional HTC (e.g., CF after full carbonization). Only the density of the fiber fully carbonized seems to follow the trend of the density of the fiber after LTC (the LTC fiber with the lower density produces the HTC fiber with lower density, and the LTC fiber with the higher density produces the fiber with the higher density). However, the deviation of the density between the tows after HTC is strongly attenuated, compared to the one observed after LTC. Indeed, with long (T1<1 min) or short (T2<<1 min) residence time at LTC, the deviation is obvious. This is particularly obvious when considering the densities of the fiber fully carbonized. All values lay in the 1.7900-1.8244 g/cm$^3$ range with a standard deviation of 0.0087, which is a significantly narrower range than the 1.5293-1.6801 g/cm$^3$ density range observed after LTC. Note: after LTC, the standard deviation of the density is 0.0630 g/cm$^3$ and is understandable because this calculation encompasses the values of two residence times. This type of high value is strongly mitigated after HTC.

There is no correlation between the residence time or the tow location at LTC and the value of the modulus of the final CF.

TABLE 2

Mechanical properties before and after full carbonization (LTC performed with the present invention and HTC using a conventional tubular furnace)[a, b].

| Specimen ID | Status | Density (g/cm$^3$) | Diameter (μm) | Peak Stress (ksi) | Modulus (Mpsi) | Strain (%) |
|---|---|---|---|---|---|---|
| Tow A | LTC only T1 < 1 min | 1.6390 (.0145) | 8.48 (0.4) | 137.6 (18.5) | 5.6 (0.1) | 2.56 (0.4) |
| | At beginning | 1.8099 (.0009) | 6.92 (0.3) | 523.9 (110.2) | 30.3 (0.8) | 1.65 (0.3) |
| | At end | 1.8163 (.0021) | 6.69 (0.4) | 522.3 (152.6) | 30.7 (0.7) | 1.62 (0.4) |
| | LTC only T2 << 1 min | 1.5283 (.0035) | 9.20 (0.6) | 50.2 (11.1) | 2.2 (0.2) | 4.91 (1.6) |
| | At beginning | 1.8152 (.0013) | 7.09 (0.4) | 482.7 (112.3) | 29.9 (0.7) | 1.55 (0.3) |
| | At end | 1.8153 (.0013) | 6.72 (0.4) | 466.3 (121.6) | 30.0 (0.6) | 1.49 (0.4) |
| Tow B | LTC only T1 < 1 min | 1.6801 (.0014) | 8.78 (0.4) | 169.1 (29.0) | 7.1 (0.3) | 2.38 (0.4) |
| | At beginning | 1.8204 (.0011) | 6.99 (0.5) | 535.9 (106.5) | 30.5 (1.0) | 1.67 (0.3) |
| | At end | 1.8244 (.0014) | 7.17 (0.5) | 542.0 (105.2) | 30.3 (1.6) | 1.69 (0.3) |
| | LTC only T2 << 1 min | 1.5414 (.0006) | 8.77 (0.9) | 60.6 (11.0) | 2.4 (0.4) | 4.94 (1.3) |
| | At beginning | 1.8112 (.0041) | 6.95 (0.4) | 565.6 (166.6) | 31.1 (0.9) | 1.73 (0.5) |
| | At end | 1.8175 (.0010) | 6.96 (0.4) | 506.5 (81.4) | 31.2 (1.3) | 1.56 (0.2) |
| Tow C | LTC only T1 < 1 min | 1.6464 (.0160) | 8.67 (0.5) | 161.7 (26.6) | 6.5 (0.4) | 2.54 (0.4) |
| | At beginning | 1.8022 (.0008) | 6.87 (0.3) | 441.6 (123.9) | 31.1 (1.4) | 1.38 (0.4) |
| | At end | 1.8026 (.0024) | 6.96 (0.3) | 525.3 (81.2) | 30.7 (1.0) | 1.63 (0.2) |
| | LTC only T2 << 1 min | 1.5355 (.0007) | 8.81 (0.5) | 71.3 (10.7) | 2.6 (0.2) | 5.30 (0.8) |
| | At beginning | 1.8150 (.0056) | 6.92 (0.4) | 565.5 (125.8) | 31.3 (1.6) | 1.72 (0.4) |
| | At end | 1.8165 (.0006) | 6.71 (0.6) | 562.5 (95.8) | 30.3 (0.6) | 1.76 (0.3) |
| Tow D | LTC only T1 < 1 min | 1.6254 (.0008) | 8.59 (0.4) | 147.8 (27.5) | 5.3 (0.4) | 3.01 (0.6) |
| | At beginning | 1.8046 (.0017) | 6.74 (0.3) | 508.2 (114.7) | 30.5 (0.3) | 1.59 (0.3) |
| | At end | 1.8089 (.0018) | 6.84 (0.3) | 588.0 (119.5) | 30.4 (1.0) | 1.83 (0.3) |

TABLE 2-continued

Mechanical properties before and after full carbonization (LTC performed with the present invention and HTC using a conventional tubular furnace)[a, b].

| Specimen ID | Status | Density (g/cm$^3$) | Diameter (μm) | Peak Stress (ksi) | Modulus (Mpsi) | Strain (%) |
|---|---|---|---|---|---|---|
| | LTC only T2 << 1 min | 1.5293 (.0004) | 9.21 (0.4) | 60.7 (6.1) | 2.3 (0.1) | 5.86 (0.8) |
| | At beginning | 1.7900 (.0082) | 6.99 (0.5) | 556.7 (95.8) | 30.5 (0.5) | 1.74 (0.3) |
| | At end | 1.8026 (.0011) | 6.83 (0.6) | 512.7 (143.7) | 29.6 (0.5) | 1.65 (0.4) |

[a]Both ends of the multimeter-long HTC samples were characterized for consistency assessment. Each data point is the result of testing 20 to 25 single filaments. Standard deviation is indicated in between parentheses. All tests are done with a FAVIMAT tensile tester.
[b]Residence times are designated T1 < 1 min (typically 50-55 s; and T2 << 1 min (typically 20-30 s).

To reach the expected level of processing in less than a minute, the susceptor must reach a temperature in the 600-650° C. range, which is the typical range of LTC conventional process. This indicates:

1. In the inventive process, IR radiated from the susceptor plays an important role in the process.
2. At equivalent residence time and temperature, the inventive process provides a material with a density substantially higher than a conventional process.

Those two observations indicate the dual characteristic of this process: both direct EM coupling to the fiber tow and temperature elevation via IR heating by the susceptor contribute to the process of carbonization of the material.

Example

In this example, the impact of the amount of material in the process was evaluated. The invention was tested with two different amounts of feedstock OPF material: The first test used 4 tows and the second test used 7 tows. In each case, individual tows were spread to ~15 mm wide as they passed through the system. Both tests were done with three residence times: two residence times are shared for both tests. One residence time only is specific to each test. All residence times are in the order of a minute—where the invention is expected to operate. Both tests are performed at a constant power of 2.8 kW.

FIG. 3. Shows graphically the density profile of the tows at different residence time in the single minute range. Power is set constant at 2.8 kW (700 W per port); the stretch is also set at a fixed value.

Figure 3A:
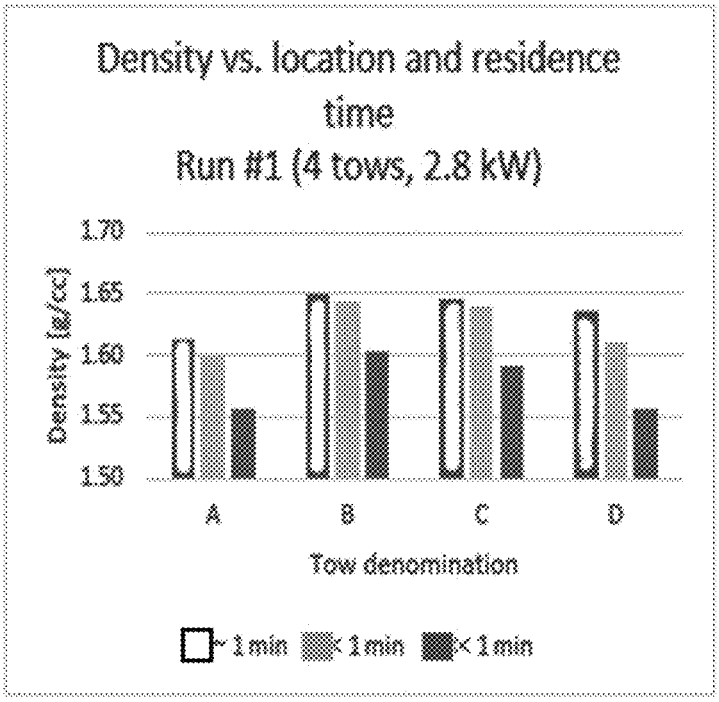
FIGS. 3A-B are plots of density vs. residence time in the inventive process.

In FIG. 3A (run #1) 4 tows (A, B, C, D) were introduced in the cavity; the three residence times are below 1 min (typically in the 25 to 55 s range). A clearance of ~15 mm was maintained between adjacent tows.

Figure 3B:
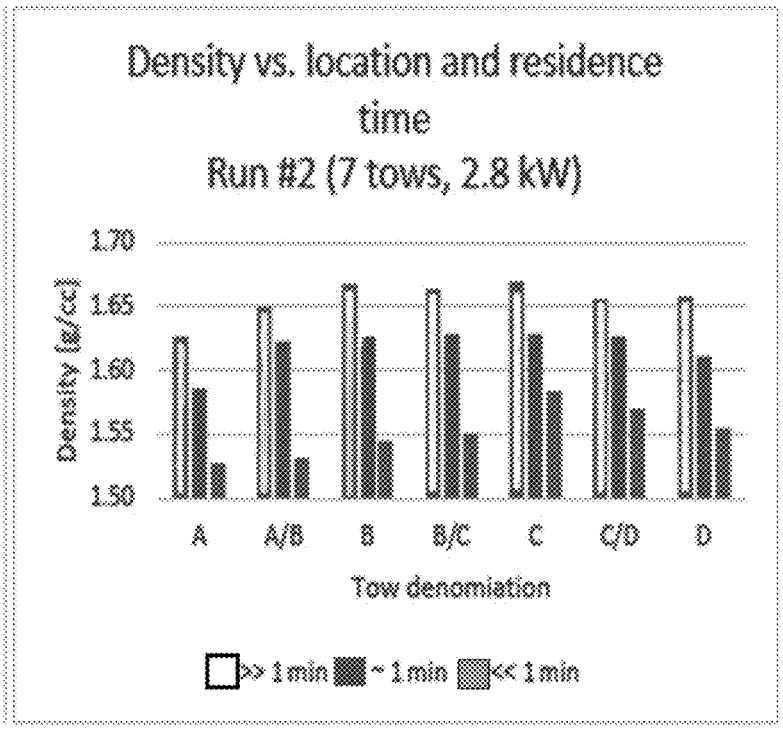

In FIG. 3B (run #2) 7 tows were processed. The positions of tows A, B, C, are D are unchanged, but the clearances between these four tows were filled with three additional tows (A/B, B/C, and C/D) and therefore do not exist anymore. So in this case, the 7 tows are effectively assimilated into one continuous wide band.

Times are slightly shorter than a minute (~1 min) and substantially shorter than a minute (<<1 min) are repeated for both runs.

All first observations indicate that the process of carbonization occurs at a higher rate than with a conventional electrical furnace. The last observation indicates that the design will benefit from further tuning and adjustments.

When comparing density measurements of the two tests, run #1 (4 tows) and run #2 (7 tows) reported in FIG. 3, it was observed that:

1. In both cases, the density of all tows drops with the reduction of the residence time.
2. All tows are sufficiently LTC processed (density >1.50 g/cm$^3$) to be further treated at HTC. However, with 7 tows, when the residence time is reduced (<<1 min), half of the material is less treated than when using a conventional process where density is expected to be ~1.56 g/cm$^3$.
3. Adding more material moderately slows the progress of the average density value.
4. In both runs, the center is always more processed than the edges and tow (A) is always the least processed. The heat ducts installed behind the susceptor contribute to limit this effect. With the increase of the residence time, this effect is attenuated, but still exists.

Example

The impact of the residence time is evaluated with 7 tows that are simultaneously processed. The power is set constant to 4 kW. A short time (<<1 min) is used as a starting set point. Then, the residence time is doubled every time. The last setting point is based on a large residence time to explore the limit of the invention but may not match with the standards for industrial adoption.

Figure 4:
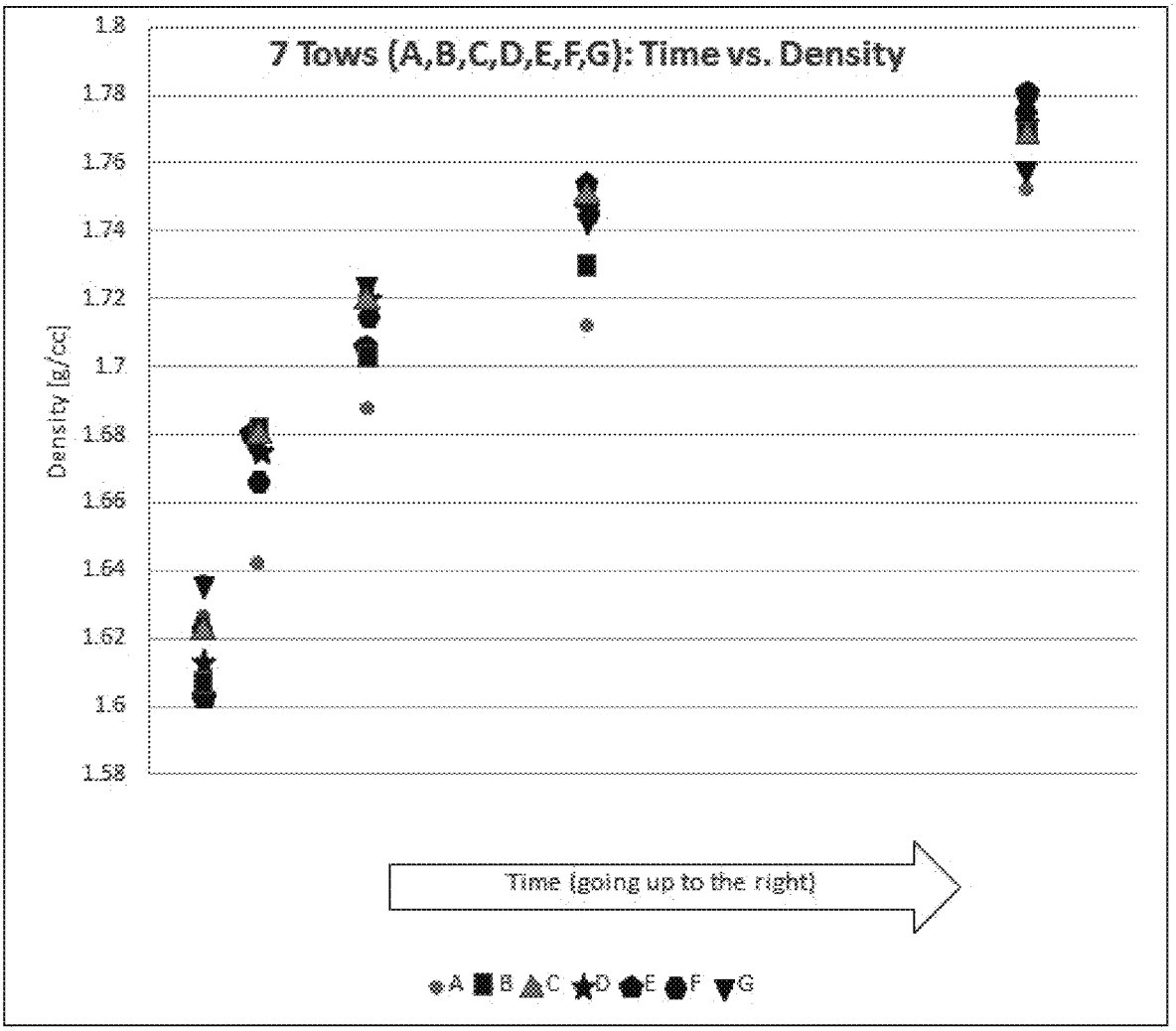
FIG. 4 presents density data for seven tows processed in accordance with some aspects of the invention.

FIG. 4 presents density measurements of 7 tows that were simultaneously processed at 4 kW with different residence times.

At this power (4 kW), the temperature of the susceptors is ~20% hotter than in the previous examples. The values of the shorter residence time can be compared with the data exposed in the preceding example. The observations are:

1. Power and temperature increase have a direct impact on the density of the material: in this dataset, all densities are higher than 1.60 g/cc).
2. With an extended residence time, this invention is able to produce fiber with a density comparable to fiber fully carbonized (most of the commercial CF show a density in the 1.76-1.81 g/cm$^3$ range, but some high modulus fiber could show density as low as 1.73 g/cm$^3$).
3. The progress of the density vs. time has a logarithmic shape. This indicates that this process has a limit at high residence time. This limit is anticipated to be equal or lower than the high end observed for CF (i.e., $\rho_{limit} \leq 1.83$ g/cm$^3$)

In addition to the foregoing specific examples, the skilled artisan will readily appreciate that many modifications and variations of the invention may be contemplated within the scope of the invention as claimed.

The EM energy may be provided by any suitable power source, which may include: magnetrons, klystrons, gyrotrons, traveling wave tubes, and solid state power amplifiers. The power supply may operate at any suitable frequency; when operating at frequencies outside of the recognized ISM bands, RF chokes may be installed on the end slits to reduce electromagnetic emissions to comply with communications regulations.

Many suitable solid state power supplies are commercially available. Some examples include: model PTS-8 (Cellencor, Inc., Ankeny, IA); model GMS-200 (Sairem, 69150 Décines-Charpieu, France); model RIU256K0-40T (RFHIC Corporation, Republic of Korea); model MR1000D-200ML (Gerling Applied Engineering, Inc., Modesto, CA); and others.

Those skilled in the art will appreciate that all dimensions given herein are simply illustrative of one working system designed for operation at 2.45 GHz, and are therefore non-limiting, as the invention may be adapted to use a power supply operating on another frequency, in which case many physical dimensions will be adjusted accordingly.

The applicator cavity may be constructed from any suitable metal alloys by any convenient fabrication processes as are well known in the art. Nonmetallic components may be fabricated from any suitable insulating material having appropriate dielectric properties such as glass, glass-ceramics, ceramic composites, and machinable glass-ceramics.

The carbon fiber precursor material may be cellulose, pitch-based fibers including isotropic and mesophase pitch, rayon, polyacrylonitrile (PAN), nylon-based fibers, and others and may be subjected to conventional pretreatments, including prestretching, and stabilization in an oxidizing environment at 200-400° C. for several hours. After low temperature carbonization in the EM process described in the various examples, the carbon fiber may be subjected to further process steps that may include: high temperature carbonization, typically between 800 and 1500° C.; graphitization treatment typically between 2000 and 3000° C.; surface treatment in an electrolytic or acidic bath; and coating with a sizing material.

The processing chamber 51 and its associated power supply forms a process module intended to replace the conventional radiant heated low temperature carbonization stage (outlined by the dashed box in FIG. 1) in a continuous carbon fiber production line. It is therefore necessary for the fiber tow 52 to move through this process stage at the same speed as it moves through the production line generally. The skilled artisan will appreciate that by routine experimentation and engineering, the variables of chamber temperature, microwave power, and the physical dimensions of the cavity may be adjusted so that the prevailing speed of the fiber tow will allow adequate residence time in the applicator cavity, and that the amount of stretch applied to the fiber in this module might be different from that applied during the conventional LTC process. Furthermore, Applicants' experimental results suggest that the invention performs LTC somewhat more effectively than the conventional process, and in some cases may allow the next process stage (HTC) to be shortened somewhat, thereby providing further efficiency gains for the total production process.

The temperature of the susceptor blocks may be measured by any suitable means as are well known in the art, including thermocouples, resistive temperature devices, fiber optic probes, IR detectors, etc.

The control system may rely on any suitable control strategies, including following a preprogrammed process recipe, or using feedback control based on inputs provided by a user or by various process sensors such as temperature and reflected power. The process control system may have the capability to adjust MW power, MW frequency, gas flow, tow speed, and other variables. Although the waveguide standoff is illustrated as a system intended to be manually adjusted prior to a particular run, it will be understood that actuators could be added, as are well known in the art, so that the control system could adjust the waveguide standoff distance in real time based on process data.

The susceptor plate may be constructed of any suitable material having appropriate dielectric loss at the frequencies of interest. It may be homogeneous or it may be a composite body containing, e.g., thermally conductive elements at the temperature range of interest to spread the temperature more evenly across the plate. It may further be functionally graded so that the dielectric loss is greater in areas where the impinging MW power is weaker, and lower in areas where the impinging MW power is stronger.

The insulating materials that hold the susceptor in place may be any suitable ceramic material, including alumina, silica, mullite, zirconia, zircon, fiberglass, rock wool, and mixtures thereof. Rigid plates of insulating material may further be used in place of the fused quartz tube for building the furnace assembly.

We claim:

1. An apparatus to partially carbonize stabilized carbon fiber precursor materials comprising:

a power supply and transmission line to provide a source of electromagnetic energy of a selected power and frequency into a waveguide;

an applicator cavity including:

at least one open waveguide launcher operable to deliver said electromagnetic energy into said cavity; and, a plate of susceptor material facing said open waveguide launcher in the near-field region of said launcher and spaced apart therefrom to form a gap through which a tow of carbon fiber precursor material may pass between said susceptor and said launcher so that said material is simultaneously directly exposed to said electromagnetic energy from said open waveguide and to radiant thermal energy from said susceptor plate;

openings in both ends of said applicator cavity, so that said precursor material may pass through said cavity as a continuous fiber tow in a selected atmosphere at ambient pressure; and, a control system and user interface to monitor and control said power supply based on selected process inputs.

2. The apparatus of claim 1 wherein said source of electromagnetic energy comprises a device selected from the group consisting of: magnetrons, klystrons, gyrotrons, traveling wave tubes, and solid state power amplifiers.

3. The apparatus of claim 1 wherein said frequency of electromagnetic energy is between 1 MHz and 300 GHZ.

4. The apparatus of claim 3 wherein said frequency of electromagnetic energy comprises a selected bandwidth about a center frequency of 2.45 GHZ.

5. The apparatus of claim 1 wherein said susceptor body and said open waveguide launcher are spaced apart from one another so that said gap is no less than 0.2 mm and no more than one wavelength at the selected operating frequency.

6. The apparatus of claim 1 wherein said launch structure comprises two identical waveguide openings on opposite sides of said fiber tow and offset from one another on opposite sides of the centerline of said fiber tow so that a wider tow may be heated more uniformly.

7. The apparatus of claim 1 wherein said waveguide further comprises an adjustable standoff whereby the distance from said open waveguide to said fiber tow may be adjusted.

8. The apparatus of claim 1 wherein said openings on both ends of said cavity further comprise RF chokes to reduce the leakage of electromagnetic energy from said applicator cavity.

9. The apparatus of claim 1 wherein said susceptor material comprises a dielectric having a loss tangent defined by tan $\delta>0.01$ at said selected operating frequency.

10. The apparatus of claim 9 wherein said susceptor material further comprises thermally conductive elements on the surface facing away from said fiber tow to provide lateral heat transfer for improved temperature uniformity across said susceptor.

11. The apparatus of claim 1 further comprising:

a supply of inert gas surrounding said fiber tow during processing to prevent oxidation thereof; and, a fiber handling system to maintain a selected tension on said fiber tow during processing.

12. A method to partially carbonize stabilized carbon fiber precursor materials including the steps of:

providing a source of electromagnetic energy of a selected power and frequency;

delivering said electromagnetic energy to an open waveguide structure to launch said electromagnetic energy into a cavity;

providing a body of susceptor material in the near-field region in front of said open waveguide and spaced apart therefrom to form a gap through which said precursor material may pass between said susceptor material and said open waveguide as a continuous fiber tow in a selected atmosphere at ambient pressure; and, pulling said fiber tow through the gap at a selected speed so that the tow is exposed to direct electromagnetic energy from said open waveguide and simultaneously to radiant thermal energy produced in said susceptor material by electromagnetic energy absorbed therein.

13. The method of claim 12 wherein:

said source of electromagnetic energy comprises a device selected from the group consisting of: magnetrons, klystrons, gyrotrons, traveling wave tubes, and solid state power amplifiers; and, said frequency of electromagnetic energy is between 1 MHz and 300 GHZ.

14. The method of claim 13 wherein said frequency of electromagnetic energy comprises a selected bandwidth about a center frequency of 2.45 GHZ.

15. The method of claim 12 wherein said susceptor body and said open waveguide launcher are spaced apart from one another so that said gap is no less than 0.2 mm and no more than one wavelength at the selected operating frequency.

16. The method of claim 12 wherein said launch structure comprises two identical waveguide openings on opposite sides of said fiber tow and offset from one another on opposite sides of the centerline of said fiber tow so that a wider tow may be heated more uniformly.

17. The method of claim 12 wherein said waveguide further comprises an adjustable standoff whereby the distance from said open waveguide to said fiber tow may be adjusted.

18. The method of claim 12 wherein said openings on both ends of said cavity further comprise RF chokes to reduce the leakage of electromagnetic energy from said applicator cavity.

19. The method of claim 12 wherein said susceptor material comprises a dielectric having a loss tangent defined by tan $\delta>0.01$ at said selected operating frequency.

20. The method of claim 12 further comprising the steps of:

providing a supply of inert gas surrounding said fiber tow during processing to prevent oxidation thereof; and, providing a fiber handling system to maintain a selected tension on said fiber tow as said tow is pulled through said cavity during processing.

* * * * *